US010316576B2

(12) United States Patent
Schweiss

(10) Patent No.: US 10,316,576 B2
(45) Date of Patent: Jun. 11, 2019

(54) OVERHEAD DOOR AND FRAME ASSEMBLY

(71) Applicant: Michael L. Schweiss, Fairfax, MN (US)

(72) Inventor: Michael L. Schweiss, Fairfax, MN (US)

(73) Assignee: SORREL QUARTERS, LLC, Hector, MN (US)

( * ) Notice: Subject to any disclaimer, the term of this patent is extended or adjusted under 35 U.S.C. 154(b) by 0 days.

(21) Appl. No.: 14/751,620

(22) Filed: Jun. 26, 2015

(65) Prior Publication Data

US 2015/0376933 A1 Dec. 31, 2015

Related U.S. Application Data

(60) Provisional application No. 61/998,361, filed on Jun. 26, 2014.

(51) Int. Cl.

| | |
|---|---|
| ***E06B 3/38*** | (2006.01) |
| ***E05F 15/53*** | (2015.01) |
| ***E05D 3/02*** | (2006.01) |
| ***E05D 5/12*** | (2006.01) |
| ***E05F 15/622*** | (2015.01) |
| ***E06B 3/01*** | (2006.01) |
| ***E05F 15/51*** | (2015.01) |
| ***E06B 1/12*** | (2006.01) |
| ***E06B 1/52*** | (2006.01) |
| ***E06B 3/48*** | (2006.01) |
| ***E06B 3/968*** | (2006.01) |

(Continued)

(52) U.S. Cl.

CPC ..... *E06B 3/38* (2013.01); *E05D 3/02* (2013.01); *E05D 5/12* (2013.01); *E05F 15/51* (2015.01); *E05F 15/53* (2015.01); *E05F 15/622* (2015.01); *E06B 1/12* (2013.01); *E06B 1/522* (2013.01); *E06B 3/01* (2013.01); *E06B 3/483* (2013.01); *E06B 3/968* (2013.01); *E06B 3/9687* (2013.01); *E05D 7/009* (2013.01); *E05Y 2600/45* (2013.01); *E05Y 2900/106* (2013.01); *E05Y 2900/108* (2013.01); *E06B 2003/7044* (2013.01)

(58) Field of Classification Search

CPC ..... E06B 3/01; E06B 3/06; E06B 3/12; E06B 3/38; E06B 2003/7044; E06B 2003/38; E06B 2003/12; E06B 2003/06; E06B 2003/01; E05F 15/53; E05Y 2900/106; E05Y 2900/108

USPC ..... 49/504, 505

See application file for complete search history.

(56) References Cited

U.S. PATENT DOCUMENTS 2,841,835 A * 7/1958 Nardulli ..... E06B 3/44 49/464

2,888,718 A * 6/1959 Francotte ..... E06B 3/12 49/390

(Continued)

FOREIGN PATENT DOCUMENTS

GB 1 225 551 * 3/1971

*Primary Examiner* — Gregory J Strimbu

(74) *Attorney, Agent, or Firm* — Richard John Bartz

(57) ABSTRACT

A frame assembly supporting an overhead door has a horizontal header connected to upright columns or posts with splice assemblies. Fasteners mounted on the columns cooperate with retainers on the splice assemblies to position and connect the columns to the header. Hinge assemblies pivotally mount the door on the header for movement between open and closed positions.

13 Claims, 24 Drawing Sheets

(51) Int. Cl.
*E05D 7/00* (2006.01)
*E06B 3/70* (2006.01)

(56) References Cited

U.S. PATENT DOCUMENTS

| | | | | | |
|---|---|---|---|---|---|
| 4,528,718 | A * | 7/1985 | Brockhaus | E05D 5/12 | 16/266 |
| 4,676,686 | A * | 6/1987 | Eisenloffel | A47G 1/10 | 40/759 |
| 4,739,600 | A * | 4/1988 | Lynch | E06B 3/9647 | 403/382 |
| 5,375,383 | A * | 12/1994 | Lin | E06B 1/522 | 49/505 |
| 5,647,172 | A * | 7/1997 | Rokicki | E06B 3/50 | 160/381 |
| 6,742,303 | B2 | 6/2004 | Pedemonte | | |
| 6,866,080 | B2 | 3/2005 | Schweiss | | |
| 6,883,273 | B2 | 4/2005 | Kerkvliet | | |
| 2002/0029524 | A1 * | 3/2002 | Kerkvliet | E05D 11/00 | 49/200 |
| 2011/0185635 | A1 * | 8/2011 | Keller | E05F 15/04 | 49/327 |
| 2011/0225895 | A1 | 9/2011 | Peterson | | |

* cited by examiner

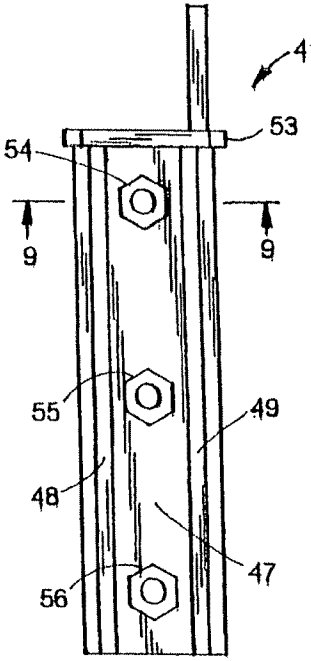
FIG.6
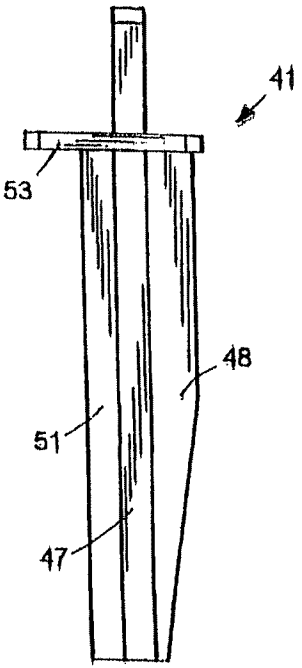
FIG.7
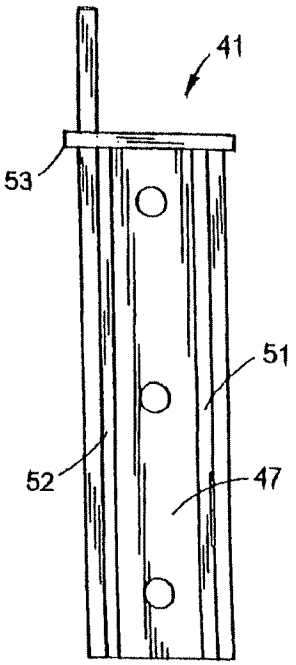
FIG.8
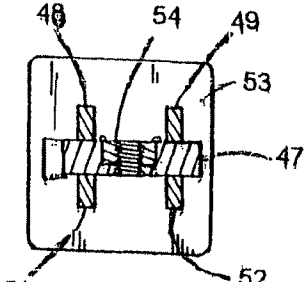
FIG.10
FIG.11
FIG.9

OVERHEAD DOOR AND FRAME ASSEMBLY

CROSS REFERENCE TO RELATED APPLICATION

This application has the priority benefit of U.S. Provisional Patent Application Ser. No. 61/998,361 filed Jun. 26, 2014.

FIELD OF THE INVENTION

The overhead door frame assembly is in the art of a door for a structure having a doorway that is selectively opened and closed with a door mounted on a frame assembly. The door is a one-piece door mounted with hinges to a header of the frame assembly. Hydraulic cylinders operate to swing the door between an upright closed position to a generally horizontal open position allowing vehicles and equipment to be moved through the doorway into and out of the structure.

BACKGROUND OF THE INVENTION

Buildings have large openings or doorways for accommodating trucks, tractors, airplanes and equipment to be moved into and out of the interior spaces in the buildings. Common types of conventional doors used to open and close the doorways are horizontally sliding doors and two piece center hinged doors known as bi-fold doors. An example of a bi-fold door is disclosed by M. L Schweiss in U.S. Pat. No. 6,866,080. A plurality of hinges pivotally mount the bi-fold door to the header of the building whereby the entire weight of the bi-fold door is accommodated by the header of the building. These doors require a larger opening than is required to accommodate the open door. The overall vertical height of the doorway is compromised to compensate for the folded bi-fold door. Overhead doors are used to open and close doorways to maximize the useable space of the doorway of the structures. An example of a hydraulically operated overhead door is disclosed by D. J. Kerkvliet in U.S. Pat. No. 6,883,273. The overhead doors are mounted with hinges on load bearing frames that are separate from the building structures whereby the weight or load of the overhead doors is not subjected to the building headers or side jambs. The load bearing frames are known as free standing headers having header mainframes and upright legs. The legs are field welded on opposite ends of the headers. The legs must be straight, flush and flat with the headers to maintain the overhead doors in these designed open and closed positions. Welding fixtures and tooling are used to maintain the alignment of the legs relative to the headers during the field welding operation. The welding of the legs to the headers requires welding skills, supplies, labor and time. R. Peterson in U.S. Patent Application Publication No. 2011/0225895 discloses a door hinged to a frame secured to a building structure. The frame has a header connected to the upright posts. Connectors join the posts to the header. Fasteners such as bolts secure the connectors to the posts. Welds are also disclosed as securing the fasteners to the upright posts.

SUMMARY OF THE INVENTION

The invention is a frame assembly for supporting an overhead door operable to move between a generally upright closed position and a generally horizontal open position. The frame assembly has a horizontal open position. The frame assembly has a horizontal header supported by upright columns. Splice assemblies connect the columns to opposite ends of the header. The splice assemblies include cooperating retainers and fasteners that align the columns with the header and maintain the columns straight, flush and in the same upright plane of the header. A plurality of hinge assemblies pivotally connect a top member of the door to the header. Linear actuators such as hydraulic cylinders or motor driven screws connected to the door and columns operate to swing the door between an upright closed position and a generally horizontal open position. The frame assembly supports the weight of the door and absorbs the forces subjected to the door during the opening and closing of the door thereby eliminating most if not all weight and forces on the adjacent building structure. Each splice assembly has an upright body having a wall and opposite end edges. A plurality of upright ribs attached to the body are retained in a flat surface engagement with a column by adjustable fasteners connecting the column to the body. The fasteners include nuts secured to the body and bolts mounted on the column engageable with the nuts. In use, the bolts are turned to move the column into alignment with the header and secure the column to the splice assembly. A plurality of second adjustable fasteners comprise cooperating nuts and bolts. The bolts engage an edge of the body to hold the opposite edges of the body in engagement with the column concurrently with the engagement of the ribs with this column. The first and second adjustable fasteners retain the splice assembly in engagement with the perpendicular walls of the column. The hinge assemblies have sleeves rotatably mounted on non-rotatable pins. Door members secured to the sleeves are connected to the top member of a door frame. Header members mounted on pins adjacent the sleeves are secured to the header whereby the hinge assemblies support the door on the header of the frame assembly for movement of the door between open and closed positions.

DESCRIPTION OF THE DRAWING

FIG. 6 is front elevational view of a splice assembly of the frame assembly;

FIG. 7 is a side elevational view of the right side of FIG. 6;

FIG. 8 is a rear elevational view of FIG. 6;

FIG. 9 is a sectional view taken along line 9-9 of FIG. 6;

FIG. 10 is a top plan view of FIG. 6;

FIG. 11 is a bottom plan view of FIG. 6;

DETAILED DESCRIPTION OF THE OVERHEAD DOOR AND FRAME ASSEMBLY

Figure 1:
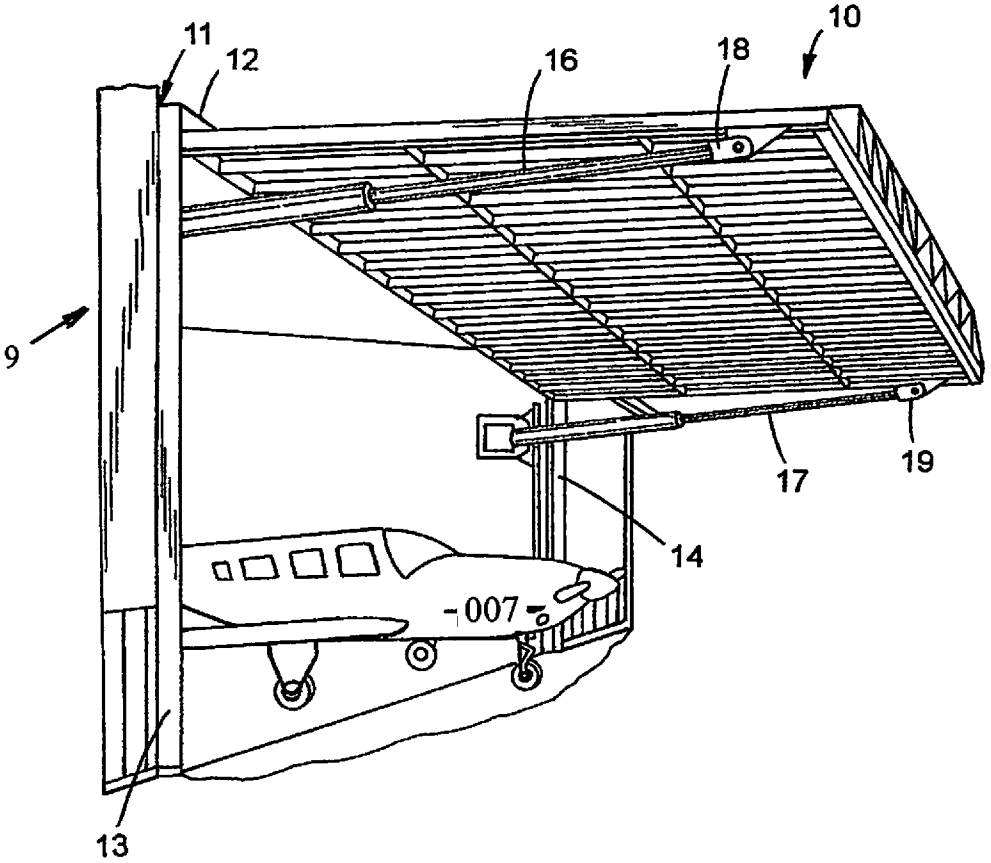
FIG. 1 is a perspective view of a building equipped with an open overhead door mounted on a frame assembly.

A building 9, shown in FIG. 1, has a doorway or opening to allow a vehicle to move into and out of the interior of the building. Examples of building 9 include aviation hangers, automotive shops, farm shops, commercial buildings, warehouses and manufacturing plants. An overhead door 10 mounted on a frame assembly 11 is movable between an upright closed position and a horizontal open position. Frame assembly 11 has a horizontal header 12 attached to upright columns or legs 13 and 14. Header 12 and columns 13 and 14 are steel tubular members. Door 10 is moved between open and closed positions with linear actuators, such as hydraulic cylinders 16 and 17 or electric motor operated screws. Spherical bearing assemblies 18 and 19 connect the rod ends of hydraulic cylinders 16 and 17 to lower side members 29 and 33 of door 10. The dead ends of hydraulic cylinders 16 and 17 are pivotally connected to cylindrical supports 21 and 22 secured to columns 13 and 14 of frame assembly 11. A hydraulic fluid pump (not shown) operatively connected to opposite ends of hydraulic cylinders 16 and 17 functions to control the flow of hydraulic fluid to and from hydraulic cylinders 16 and 17 whereby hydraulic cylinders 16 and 17 selectively move door 10 to its open and closed positions. An example of a hydraulic fluid system for a hydraulically operated overhead door with hydraulic cylinders is disclosed in U.S. Pat. No. 6,883,273. A linear actuator having a motor operated screw is disclosed in U.S. Pat. No. 6,742,303.

Figure 2:
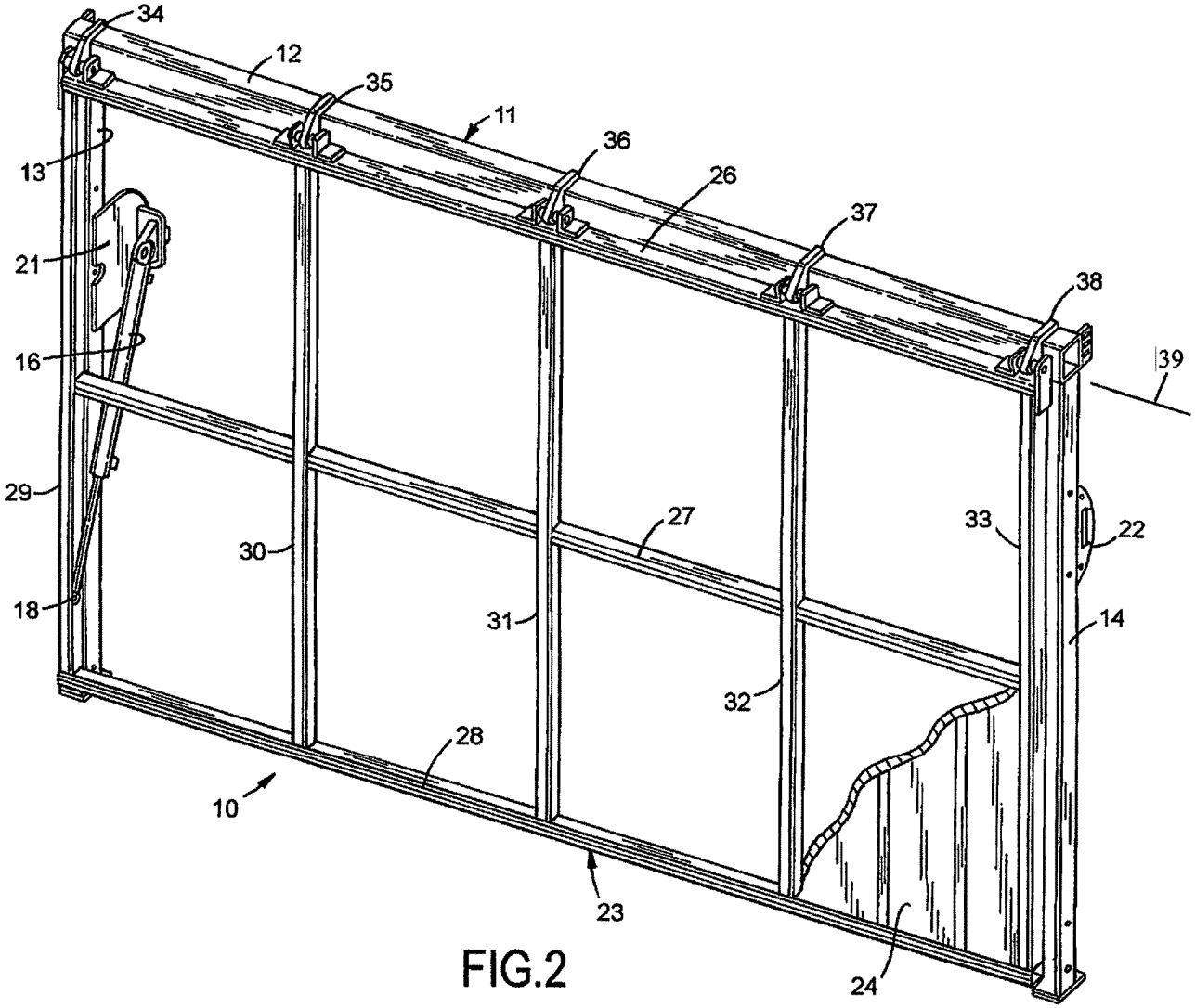
FIG. 2 is a perspective view of a first embodiment of a closed overhead door mounted on the frame assembly.
Figure 3:
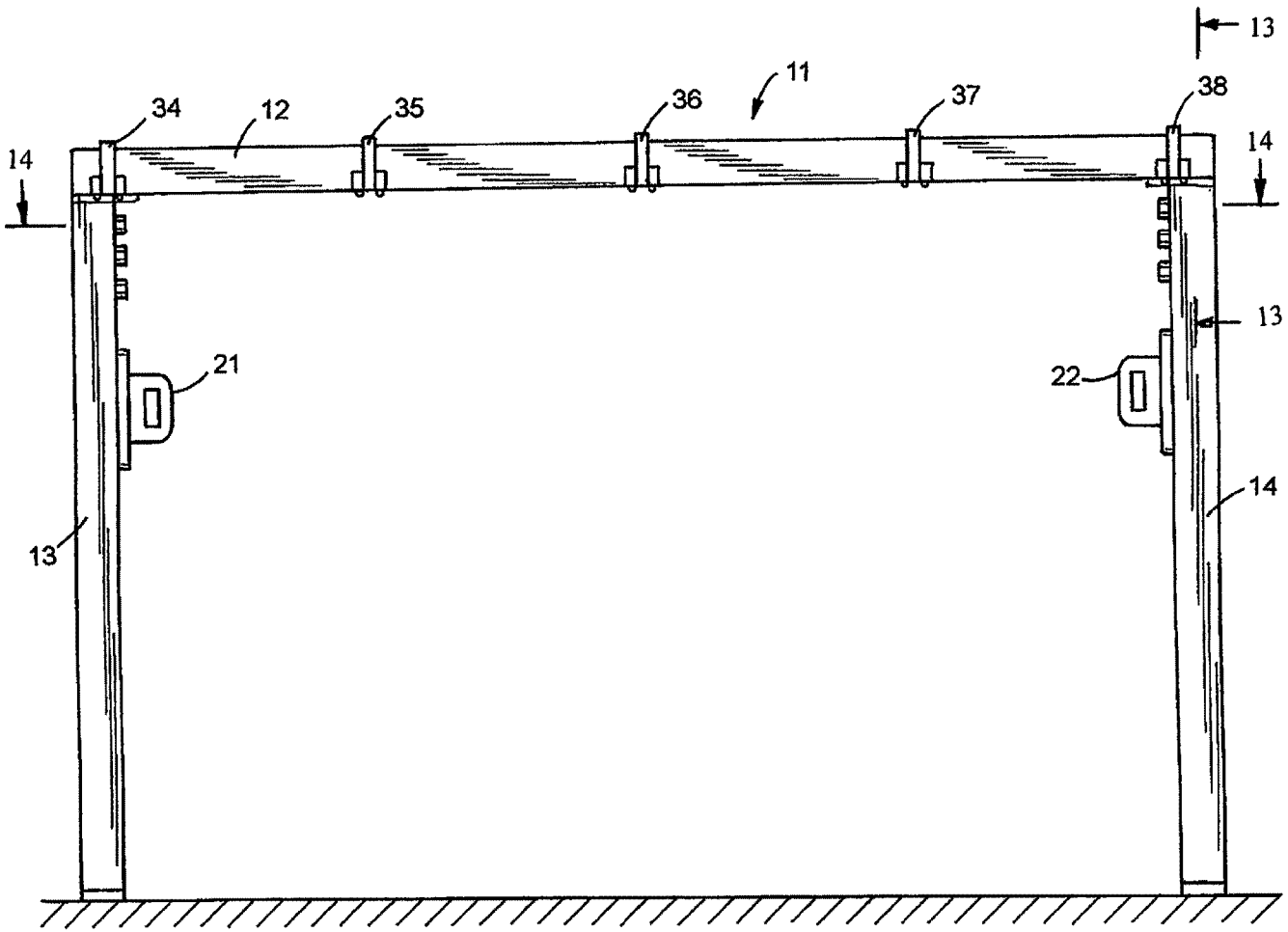
FIG. 3 is a front elevational view of the frame assembly of FIG. 2.

As shown in FIG. 2, door 10 has a rectangular frame 23 supporting sheathing 24 and trim. Frame 23 comprises tubular steel horizontal members 26, 27 and 28 secured with welds to tubular steel upright members 29, 30, 31, 32 and 33. Sheathing 24 is attached to members 26 to 33 with fasteners or an adhesive. A plurality of hinge assemblies 34, 35, 36, 37 and 38 pivotally mount door frame 23 to header 12 of frame assembly 11 for movement about a horizontal axis 39. Horizontal axis 39 established by hinge assemblies 34 to 38 is laterally of the outside surface of header 12 and parallel to the length of header 12. Hinge assemblies 34 to 38 uniformly distribute the weight of door 10 on header 12 and maintain door 10 level during its opening and closing movements.

Figure 4:
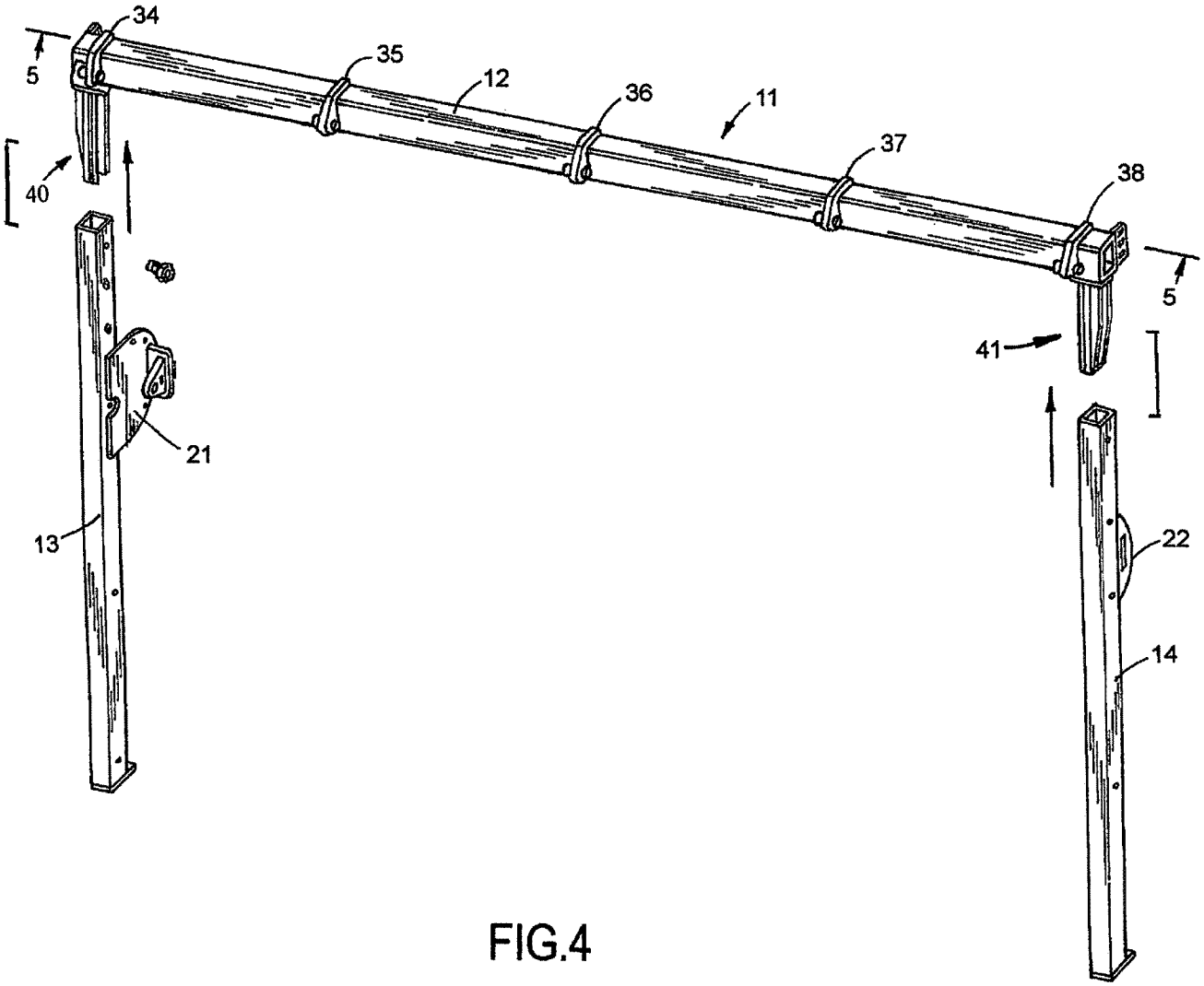
FIG. 4 is a perspective view of the frame assembly of FIG. 3 showing the frame assembly header separated from the upright side columns.
Figure 5:
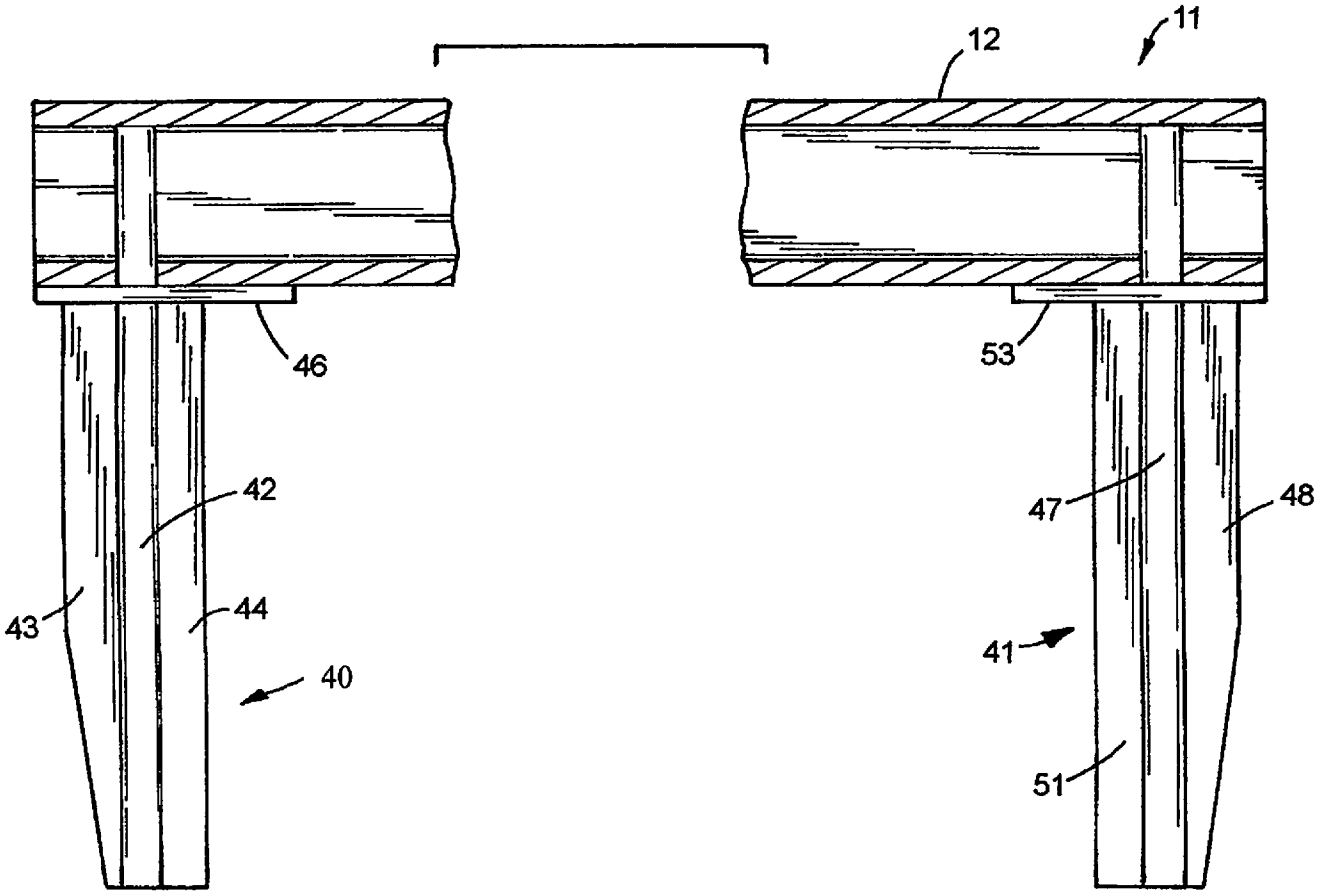
FIG. 5 is an enlarged foreshortened sectional view taken along line 5-5 of FIG. 4.
Figure 12:
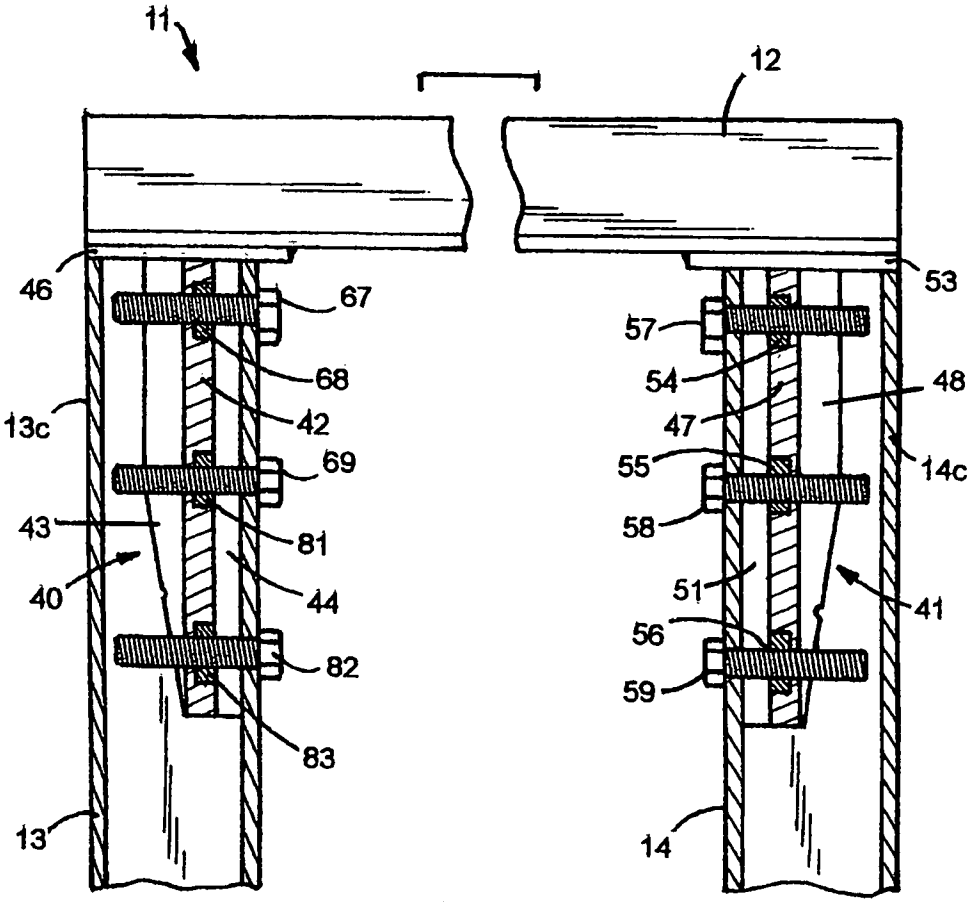
FIG. 12 is an enlarged foreshortened front elevational view, partly sectioned, of the frame assembly of FIG. 3.

Proceeding to FIGS. 4 and 5, frame assembly 11 has splice assemblies 40 and 41 attached to opposite ends of header 12. Splice assemblies 40 and 41 telescope into the open upper ends of columns 13 and 14. As shown in FIG. 12, a plurality of bolts 57, 58, 59, 67, 69 and 82 secure columns 13 and 14 to splice assemblies 40 and 41.

Splice assembly 40 has a body 42 comprising a flat member having an upper end extended into header 12. Body 42 extends downward from the end of header 12. A first pair of outside ribs or flanges 43 are secured to the outside of body 42. A second pair of inside ribs or flanges 44 and 45 are secured to the inside of body 42. Ribs 43, 44 and 45 are secured with welds to body 42. A horizontal plate 46 joined to the upper ends of ribs 43 to 45 and located in engagement with and secured to the bottom of header 12 retains splice assembly 40 in a downward 90 degree relationship with respect to header 12.

Splice assembly 41, shown in FIGS. 5 to 11, has a body 47 having an upper end extended into header 12. A first pair of ribs or flanges 48 and 49 are secured to a first side of body 47. A second pair of ribs or flanges 51 and 52 are secured to a second side of body 47. Ribs 48, 49, 51 and 52 reinforce opposite sides of body 47 and space body 47 from the side walls of column 14. Body 47 has hexagonal cavities accommodating retainers or nuts 54, 55 and 56. Welds secure nuts 54, 55, and 56 to body 47. Other types of threaded members can be secured to body 47 for accommodating bolts 57, 58 and 59. As shown in FIG. 12, body 42 has a plurality of retainers or nuts 68, 81 and 83 similar to nuts 54, 55 and 56. A horizontal plate 53 secured to the upper ends of ribs 48, 49, 51 and 52 and located in engagement with and secured to the bottom of header 12 retains splice assembly 41 in a downward 90 degree relationship with respect to header 12.

Figure 14:
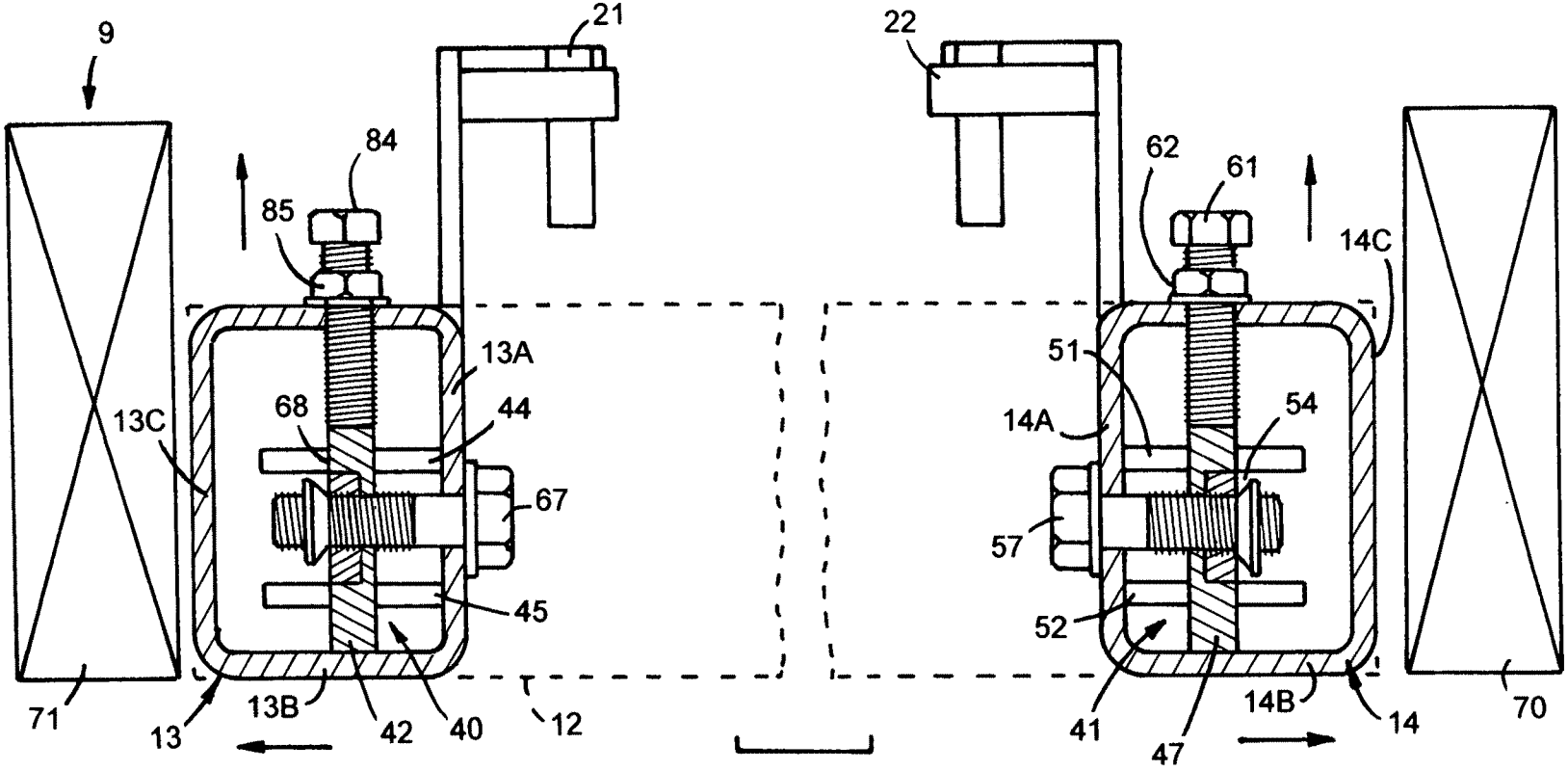
FIG. 14 is an enlarged foreshortened sectional view taken along line 14-14 of FIG. 3.

Splice assembly 40 is secured to column 13 with bolts 67, 69 and 82. Nuts 68, 81 and 83 mounted on body 42 accommodate bolts 67, 69 and 82 extended through holes in column 13. Bolts 67, 69 and 82 are turned tight to retain ribs 44 and 45 in engagement with the inside of wall 13A of column 13. The outer wall 13C of column 13 and the adjacent end of header 12 is located in vertical alignment with the second outer end of header 12. Column wall 13C has an outer surface located in the same or common vertical plane as the second end of header 12. As shown in FIG. 14, a bolt 84 threaded through a nut 85 secured to column 13 engages an end of body 42. Bolt 84 is turned tight to hold body 42 in firm contact with the inside of column wall 13B. Bolt 84 and additional bolts (not shown) contact body 42 to prevent column 13 from moving forward and rearward relative to splice assembly 40.

Returning to FIG. 2, a plurality of hinges assemblies 34 to 38 pivotally mount door 10 on header 12. Hinge assemblies 34 to 38 have a common horizontal axis 39 allowing hydraulic cylinders 16 and 19 to swing door 10 from an upright closed position to a generally horizontal open position. The open horizontal position of door 10 is shown in FIG. 1. Hinge assemblies 34 to 38 are identical in structure and function. The following description of hinge assembly 35 is applicable to hinge assemblies 34 and 36 to 38 and additional hinge assemblies used to pivotally mount door 10 on header 12.

Proceeding to FIGS. 12 and 14, columns 13 and 14 are inserted into splice assemblies 40 and 41 secured to opposite ends of header 12. A plurality of bolts 57, 58 and 59 extended through holes in column 14 are threaded into nuts 54, 55 and 56. Bolts 57, 58 and 59 are turned tight to secure column 14 to splice assembly 41 and move inner wall 14A of column 14 into firm engagement with ribs 48 and 49. Outer wall 14C of column 14 is located in vertical alignment with the first outer end of header 12. The outer surface of wall 14C of column 14 is located in the same or common vertical plane as the first end of header 12. The first end of header 12 and column 14 are located in close relationship with the adjacent surface of building wall 70.

Figure 13:
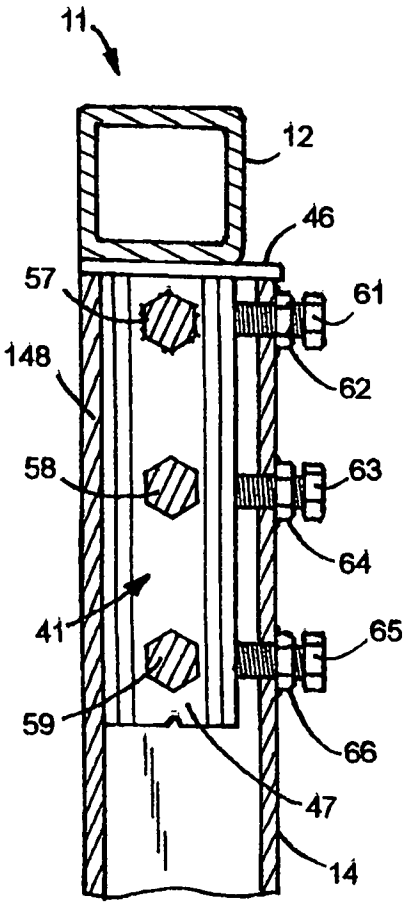
FIG. 13 is an enlarged sectional view taken along line 13-13 of FIG. 3.

As shown in FIG. 13, bolts 61, 63 and 65 threaded through nuts 62, 64 and 66 engage a side of body 47. Nuts 62, 64 and 66 are secured by welds adjacent holes in column 14. Bolts 61, 63 and 65 are turned to force body 47 into surface engagement with the inside of wall 14B of column 14. The outside surface of wall 14B of column 14 is vertically aligned with the outside front surface of header 12. The outside surface of wall 14B of column 14 and the outside front surface of header 12 are located in the same or common vertical plane.

Splice assembly 41 secured to column 14 with bolts 57, 58 and 59 and 62, 63 and 65 retains column 14 in a vertical position relative to header 12. Column 14 is prevented from moving laterally and vertically relative to header 12. Bolts 57, 58 and 59 and 61, 63 and 65 also permit adjustment of column 14 in two directions relative to the end of header 12.

Figure 15:
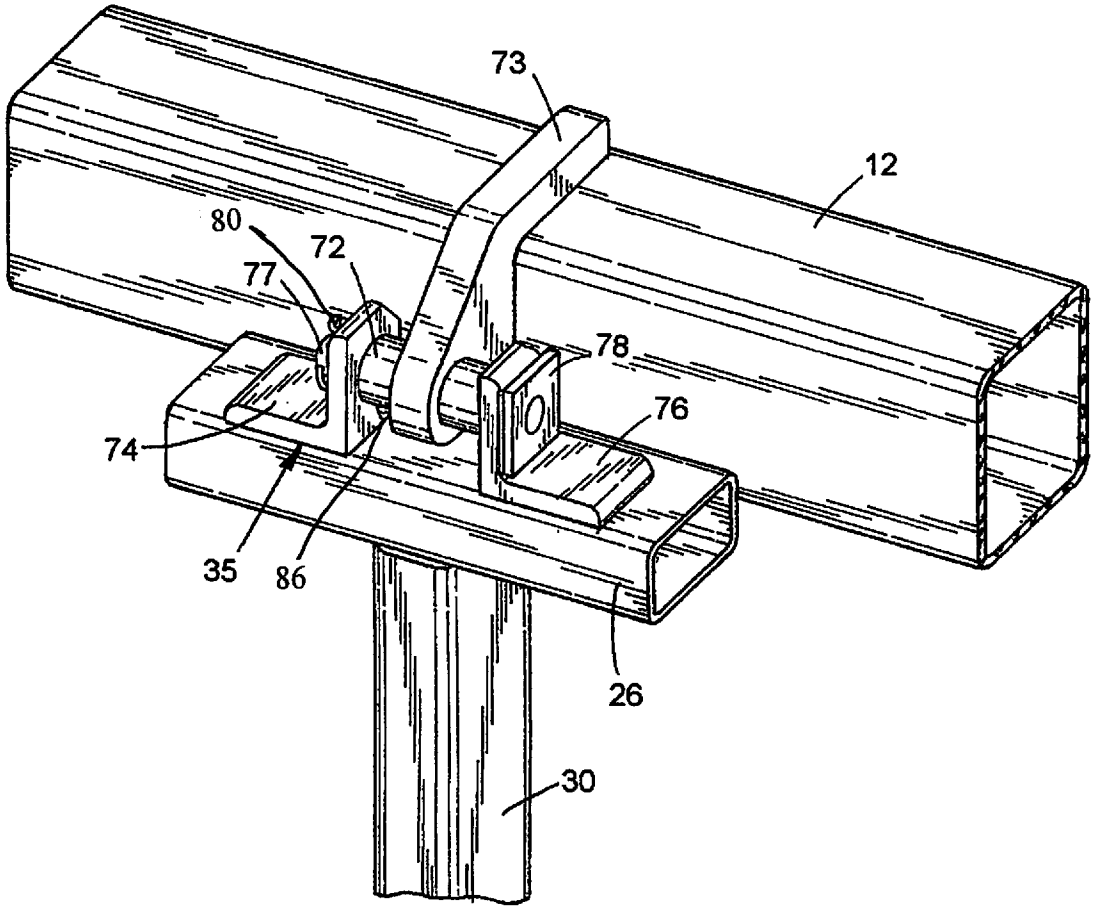
FIG. 15 is a perspective view of a hinge assembly pivotally mounting the door to the frame assembly header.

Hinge assembly 35, shown in FIG. 15, has a tubular member or sleeve 72 secured to an arm 73. Arm 73 extends across the top of header 12. Welds secure arm 73 to header 12. Left and right angle supports 74 and 76 located adjacent opposite ends of sleeve 72 accommodate a pin 77. Pin 77 extended horizontally through sleeve 72 pivotally mounts sleeve 72 and arm 73 on pin 77. Supports 74 and 76 are welded to the horizontal top door frame member 26. A square head 78 secured to an end of pin 77 prevents rotation of pin 77 relative to supports 74 and 76. Head 78 and cotter key 80 on opposite ends of pin 77 limit axial movement of pin 77 relative to supports 74 and 76. Grease zerks 86 mounted on sleeve 72 are used to apply grease to the inside cylindrical surface of sleeve 72.

Figure 16:
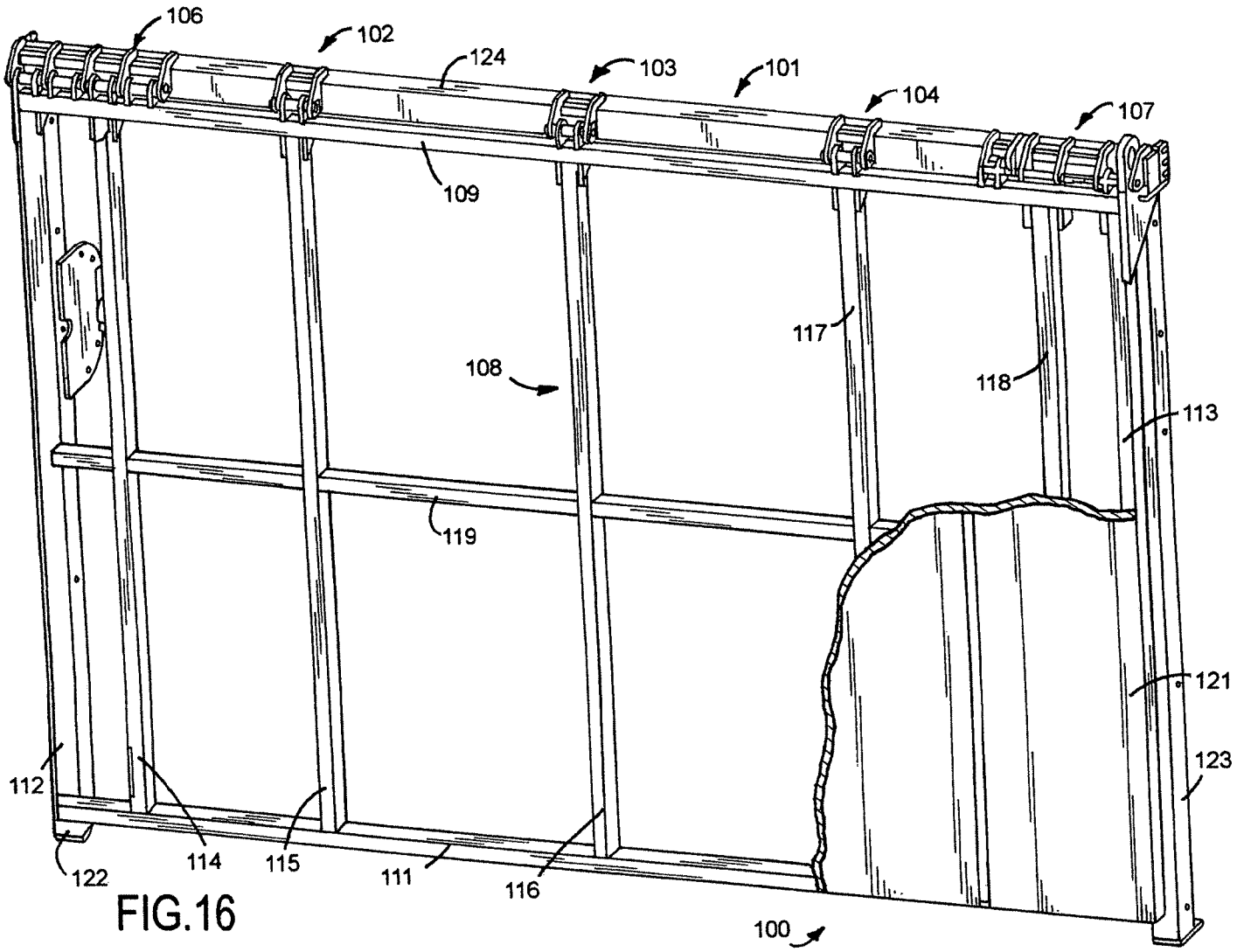
FIG. 16 is a perspective view of a second embodiment of a closed overhead door mounted on a frame assembly.

A second embodiment of an overhead door 100 and a frame assembly 101, shown in FIG. 16, illustrates door 100 pivotally connected to frame assembly 101 with a plurality of hinge assemblies 102, 103, 104, 106 and 107. Linear actuators 120 operatively connected to opposite sides of door 100 and frame 101 are used to move door 100 to open and closed positions. Linear actuators 120 are hydraulic cylinders, such as hydraulic cylinders 16 and 17 shown in FIG. 1. Linear actuators 120 can be an electric motor operated screw for moving linear members to open and close door 100.

Door 100 has a rectangular frame 108 comprising horizontal top and bottom members 109 and 111. Upright end members 112 and 113 and upright middle members 114, 115, 116, 117 and 118 extend between and are secured to top and bottom members 109 and 111. Horizontal middle members 119 located adjacent upright members 112 and 113 reinforce upright members 112 and 113. Members 109 and 111 to 119 are tubular metal bars, such as steel or aluminum tubular bars. Other materials can be used for the tubular members of door frame 108. Sheathing 121 is attached to the outside of door frame 108 with fasteners or an adhesive.

Frame assembly 101 has upright legs or columns 122 and 123 and a horizontal header 124. Columns 122 and 123 and header 124 are tubular metal members. Splice assemblies 125, shown in FIG. 17, join the upper ends of columns 122 and 123 to opposite ends of header 124. Each splice assembly 125 has the structure of splice assembly 41 shown in FIGS. 5 to 11. The lateral, forward and rearward locations of columns 122 and 123 relative to the ends of header 124 can be adjusted by each splice assembly 125.

As shown in FIGS. 19 to 26, hinge assembly 102 has a cylindrical sleeve 126 supporting a grease zerk 127 adapted to direct a lubricant, such as grease, to the inside cylindrical wall 128 of sleeve 126. Sleeve 126 is rotatably mounted on a pin 158. The lubricant facilitates rotation of sleeve 126 on pin 158. A pair of laterally spaced first or door members 129 and 130 secured to sleeve 126 are attached to top member 109 of door frame 108 whereby sleeve 126 rotates on pin 158 when door 100 is moved between open and closed positions. Member 129 has a head 132 with an opening 133 accommodating sleeve 126. Head 132 is secured with welds to sleeve 126. A neck 134 attaches head 132 to a body 136. A recess or pocket 137 is located between head 132 and body 136. Top member 109 of door frame 108 is located in pocket 137. A weld secures head 132, neck 134 and body 136 to top member 109 of door frame 108. Member 130 has a head 138 with an opening 139 accommodating sleeve 126. A neck 141 secures head 138 to a body 142. A recess or pocket 143 is located between head 138 and body 142. Necks 134 and 143 are connected with a bar 131. Welds secure head 138 to sleeve 126. Members 129 and 130 are generally parallel upright members. Grease zerk 127 located between heads 132 and 138 projects downward when door 100 is in the open position thereby allowing lubrication of sleeve 126 from a floor or ground position. Bodies 136 and 142 extend downward adjacent opposite sides of upright member 115 of door frame 108 and located hinge assembly 102 in vertical or upright alignment with member 115. Welds secure bodies 136 and 142 to upright members 115 thereby reinforcing the attachment of upright member 115 to top member 109 and reinforce the attachment of hinge assembly 102 to door frame 108.

Figure 19:
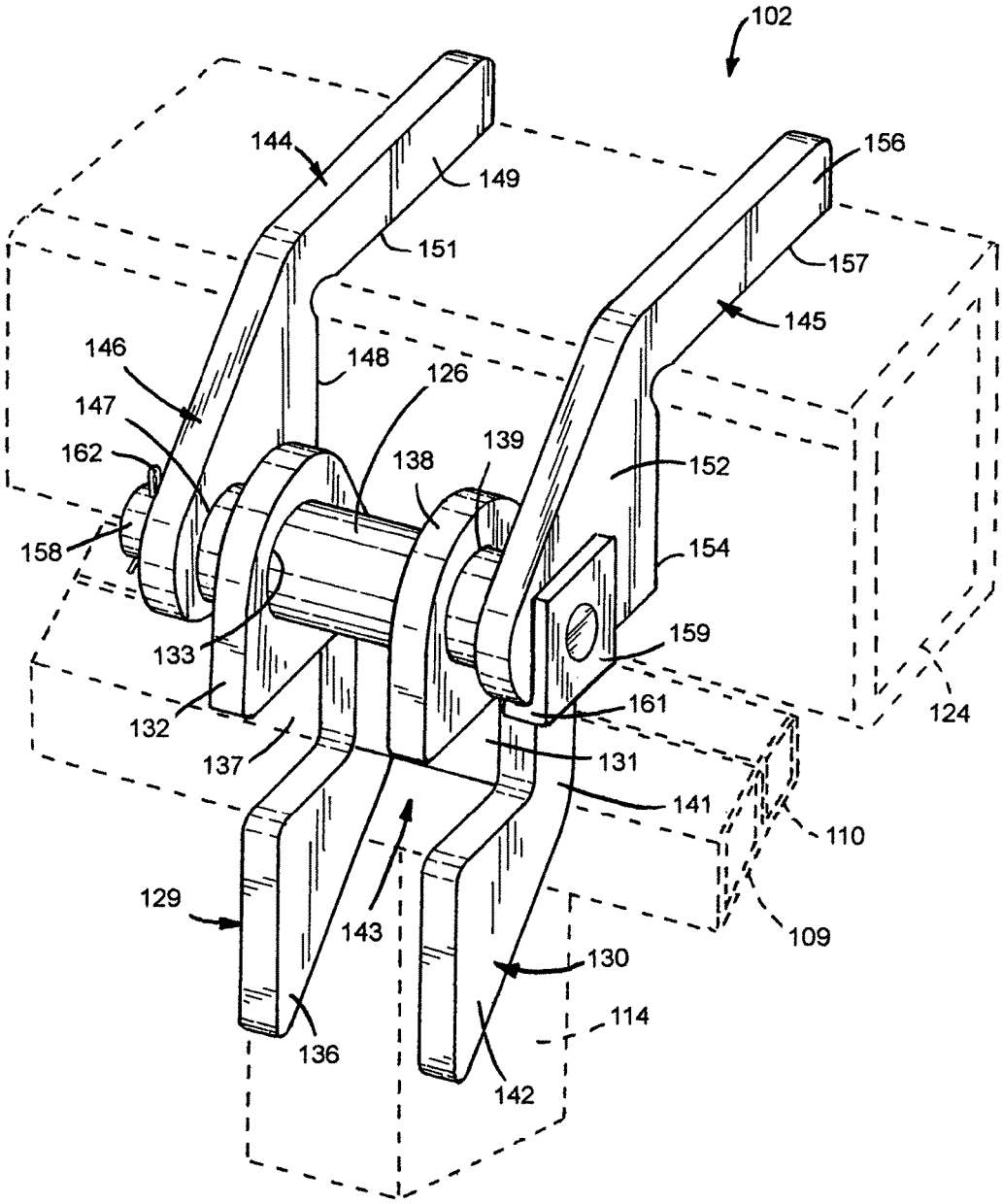
FIG. 19 is a perspective view of a center hinge assembly pivotally connecting the overhead door to the header of the frame assembly.
Figure 20:
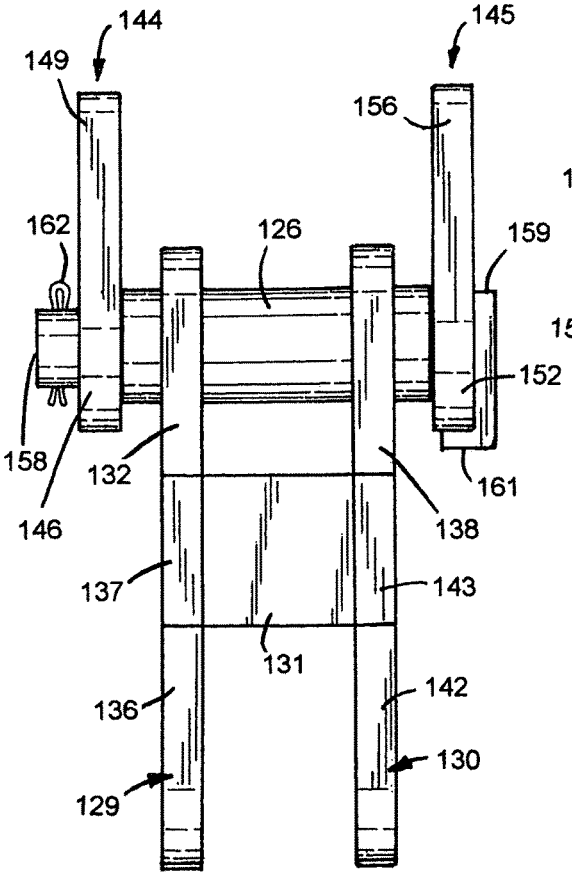
FIG. 20 is a front elevational view of the hinge assembly of FIG. 19.
Figure 21:
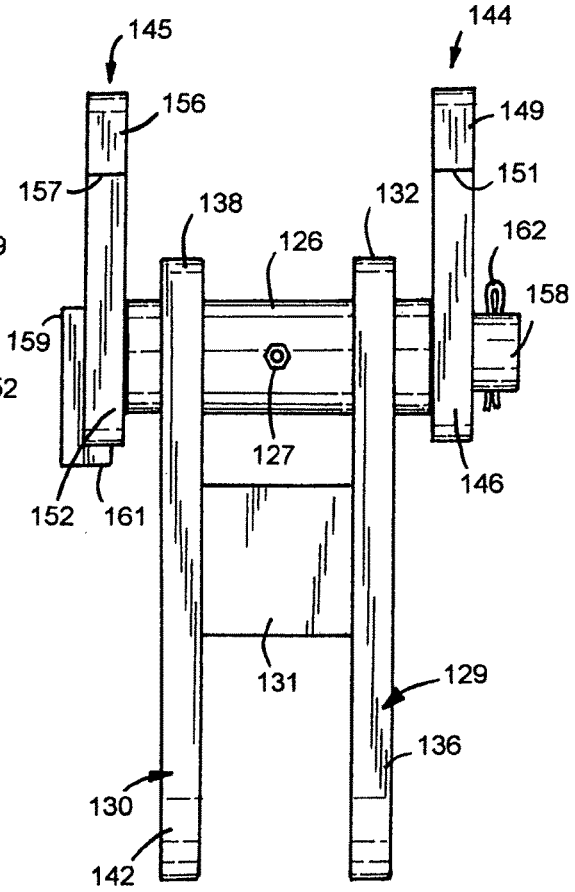
FIG. 21 is a rear elevational view of the hinge assembly of FIG. 19.
Figure 23:
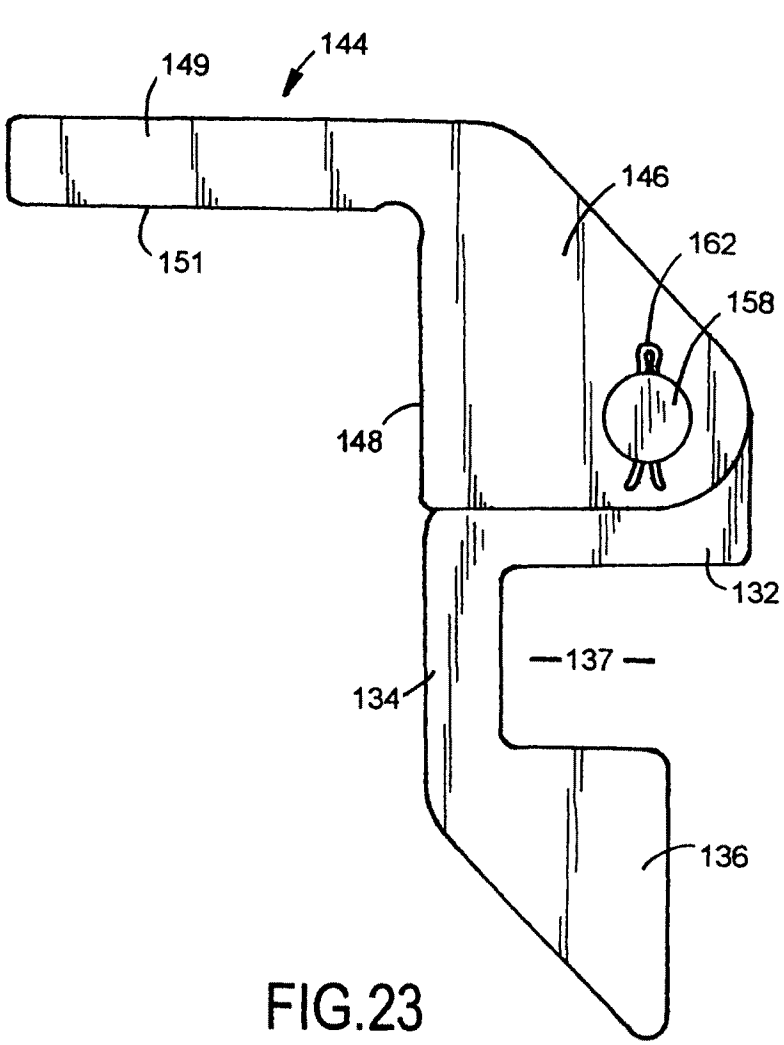
FIG. 23 is a side elevational view of the left side of the hinge assembly of FIG. 19.
Figure 22:
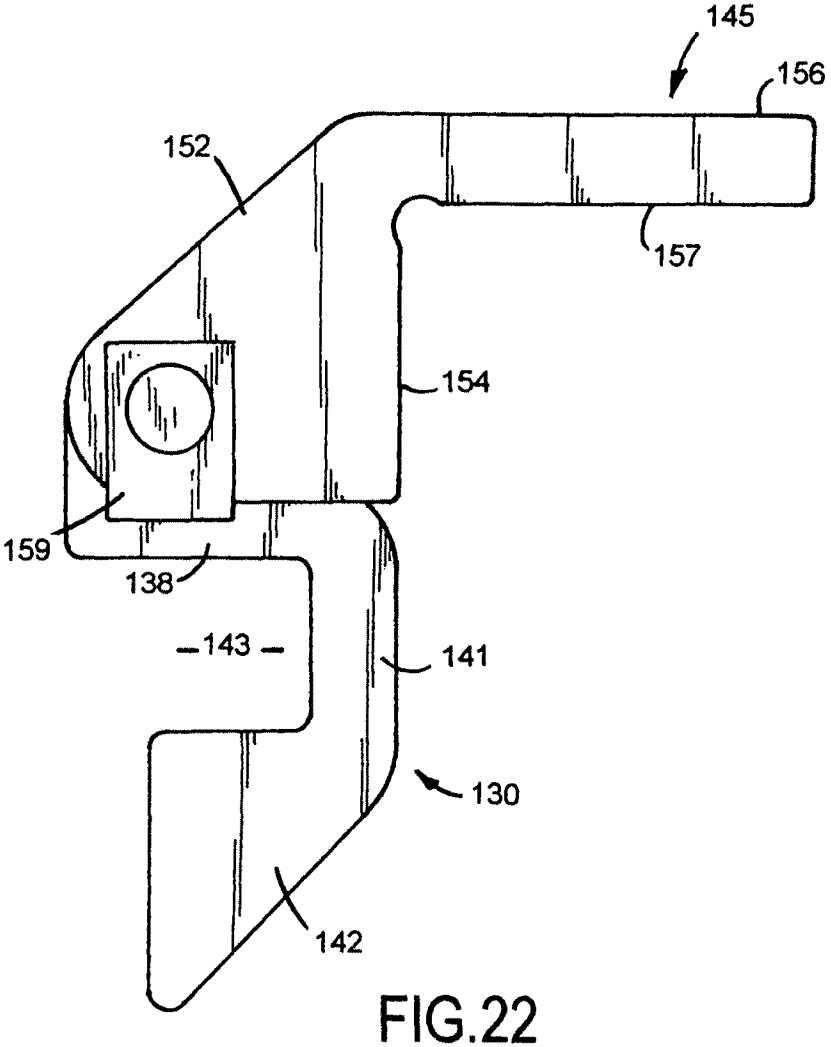
FIG. 22 is a side elevational view of the right side of the hinge assembly of FIG. 19.
Figure 25:
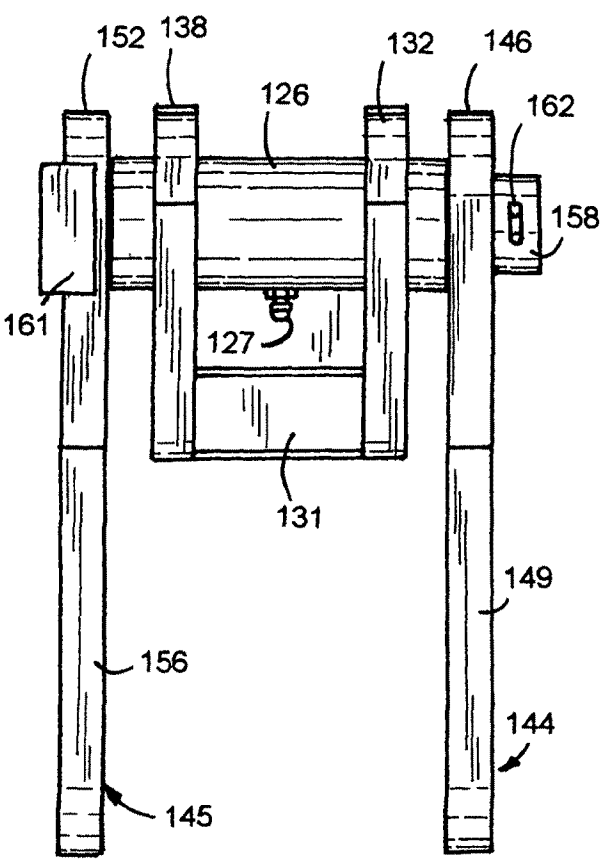
FIG. 25 is a bottom plan view of the hinge assembly of FIG. 19.
Figure 24:
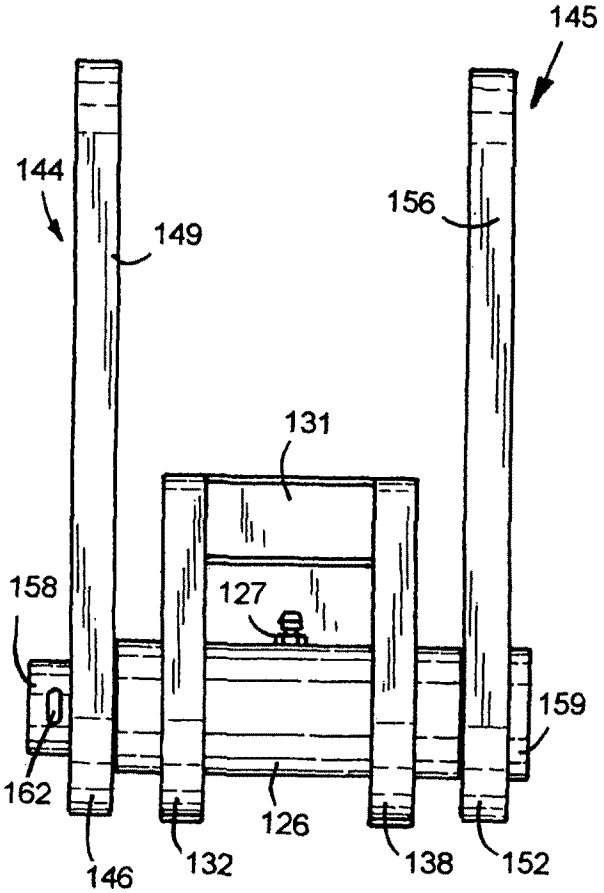
FIG. 24 is a top plan view of the hinge assembly of FIG. 19.
Figure 26:
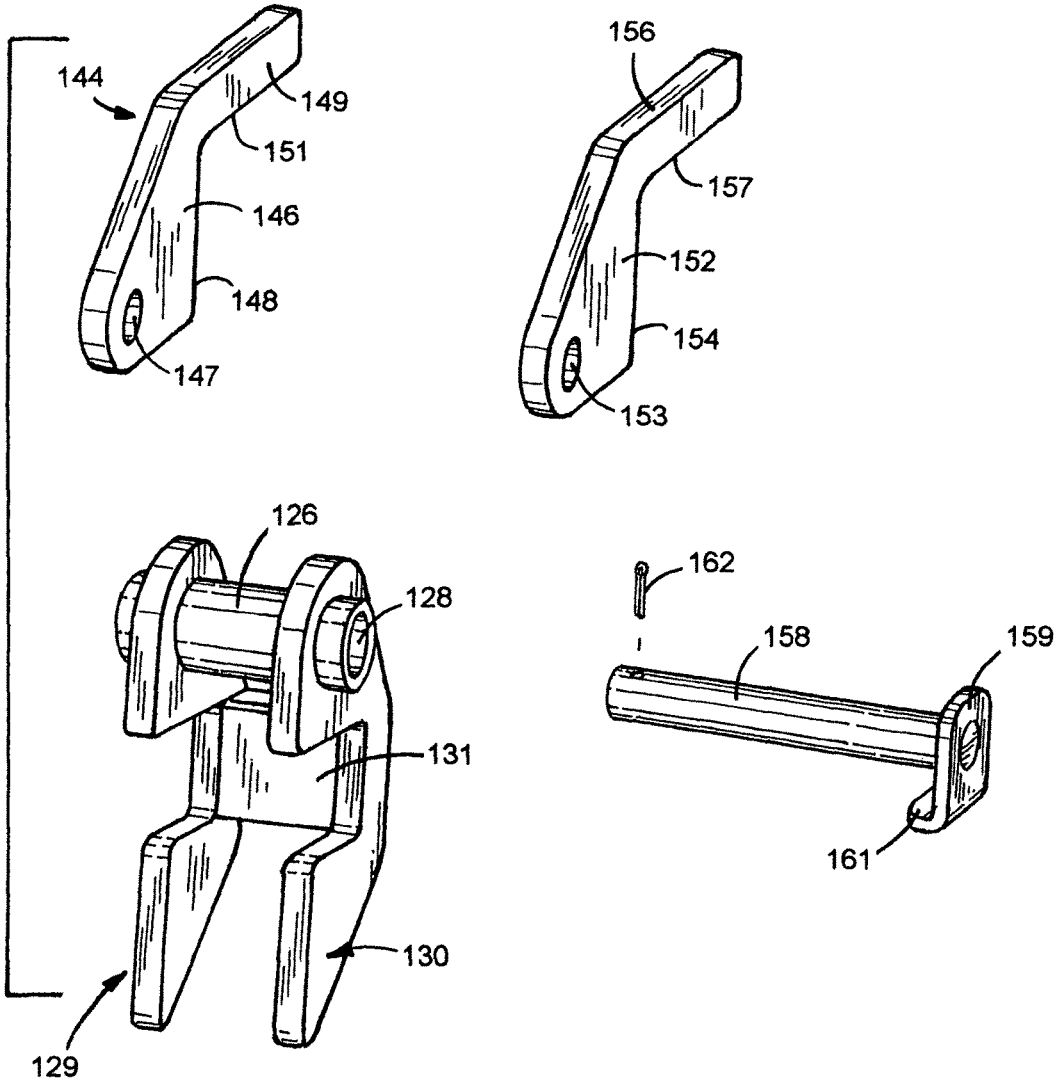
FIG. 26 is an exploded perspective view of the hinge assembly of FIG. 19.

Header members 144 and 145 located adjacent opposite ends of sleeve 126 are secured to header 124 of frame assembly 101. Header member 144 has a body 146 with an opening 147 accommodating pin 158. Body 146 has an upright wall 148 extended to a horizontal arm 149 joined to body 146. Arm 149 has a horizontal bottom wall 157. Walls 148 and 151 engage header 124 and are secured with welds to header 124. Header member 145 has a body 152 with an opening 153 accommodating pin 158. Body 152 has an upright front wall 154 extended to a horizontal arm 156 joined to body 152. Arm 156 has a horizontal bottom wall 157. Walls 154 and 157 located in engagement with header 124 are secured with welds to header 124. Header members 144 and 145 support sleeve 126 and pin 158 laterally in a horizontal position in front of header 124. A spacer bar 110 is part of door frame 108 between top member 109 and header 124. Pin 158 is retained in a non-rotatable position by header member 144. As shown in FIGS. 19, 20 and 22, a tab 159 is secured to one end of pin 158. The bottom of tab 159 has an ear 161 extended below the bottom of body 152. Ear 161 engages the bottom of body 152 to prevent rotation of tab 159 and pin 158. A retainer 162, such as a cotter pin, on the end of pin 158 opposite tab 159 limits axial movement of pin 158 on sleeve 126.

Figures 17, 18:
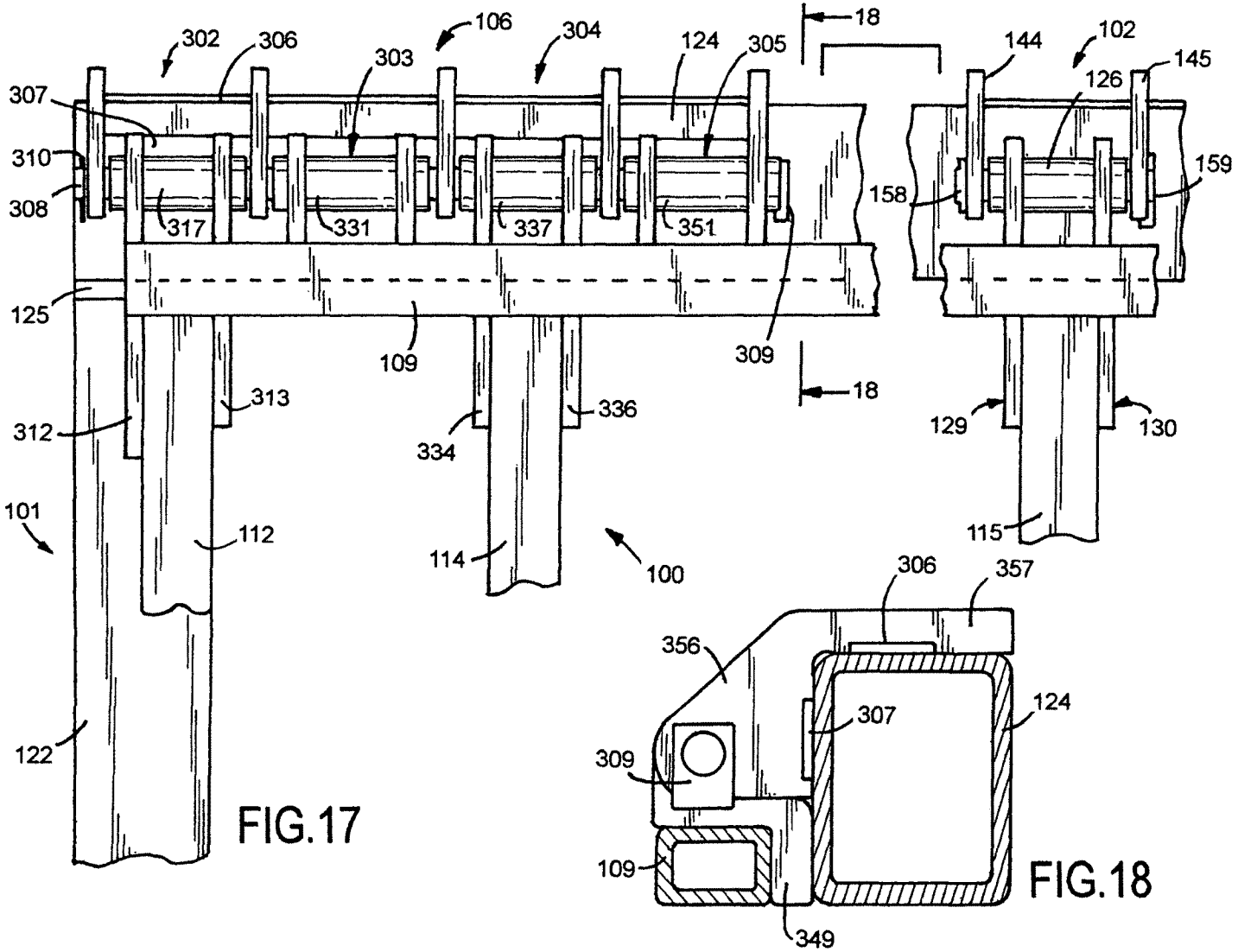
FIG. 17 is a foreshortened front elevational view of the upper left section of the overhead door and frame assembly of FIG. 16.
FIG. 18 is an enlarged sectional view taken along line 18-18 of FIG. 17.

As shown in FIGS. 16, 17 and 19, top member 109 of door frame 108 extends horizontally through pockets 137 and 143. Heads 132 and 138, necks 134 and 141 and bodies 136 and 142 are secured with welds to member 109 of door frame 108.

Figure 27:
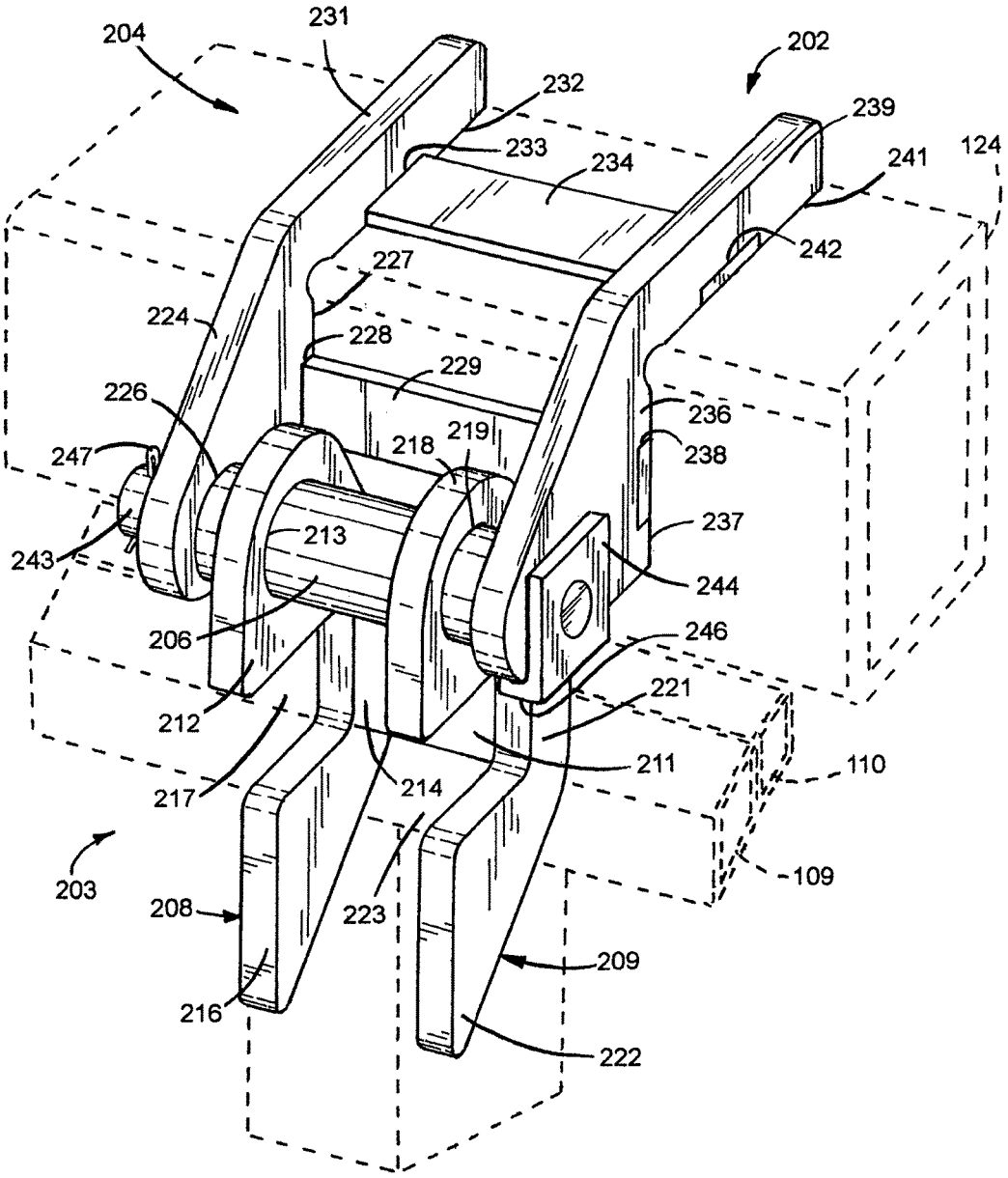
FIG. 27 is a perspective view of a modification of the center hinge assembly.
Figure 29:
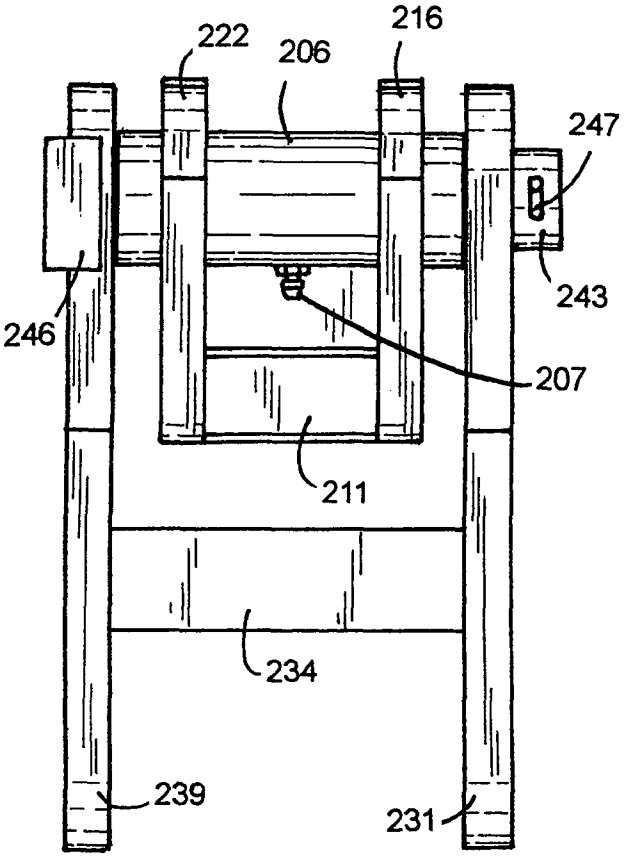
FIG. 29 is a bottom plan view of the hinge assembly of FIG. 27.
Figure 28:
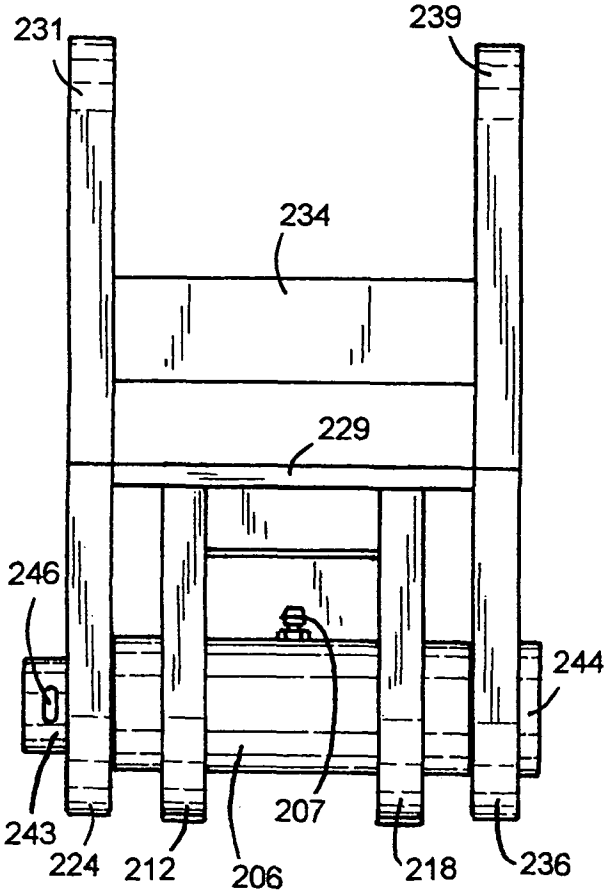
FIG. 28 is a top plan view of the hinge assembly of FIG. 27.
Figure 31:
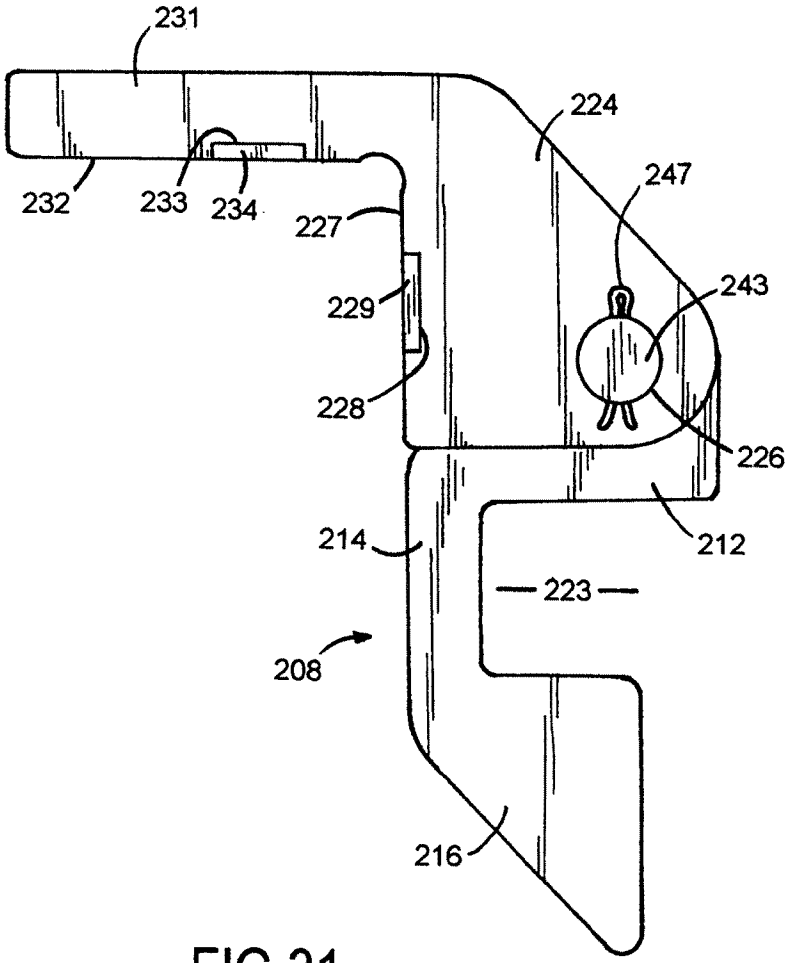
FIG. 31 is a side elevational view of the left side of the hinge assembly of FIG. 27.
Figure 30:
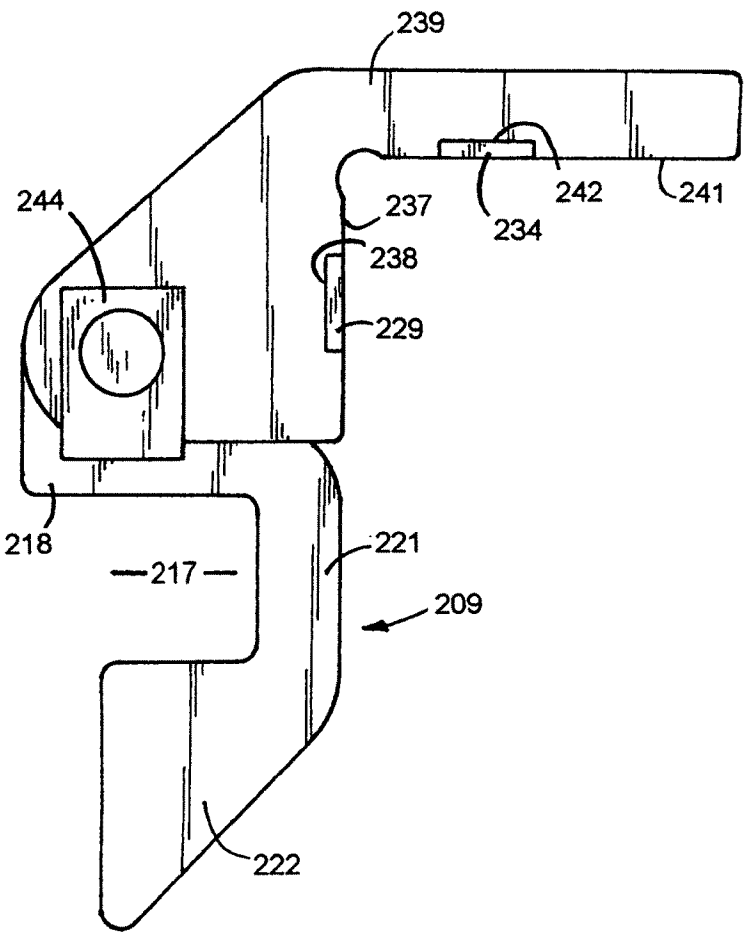
FIG. 30 is a side elevational view of the right side of the hinge assembly of FIG. 27.
Figure 33:
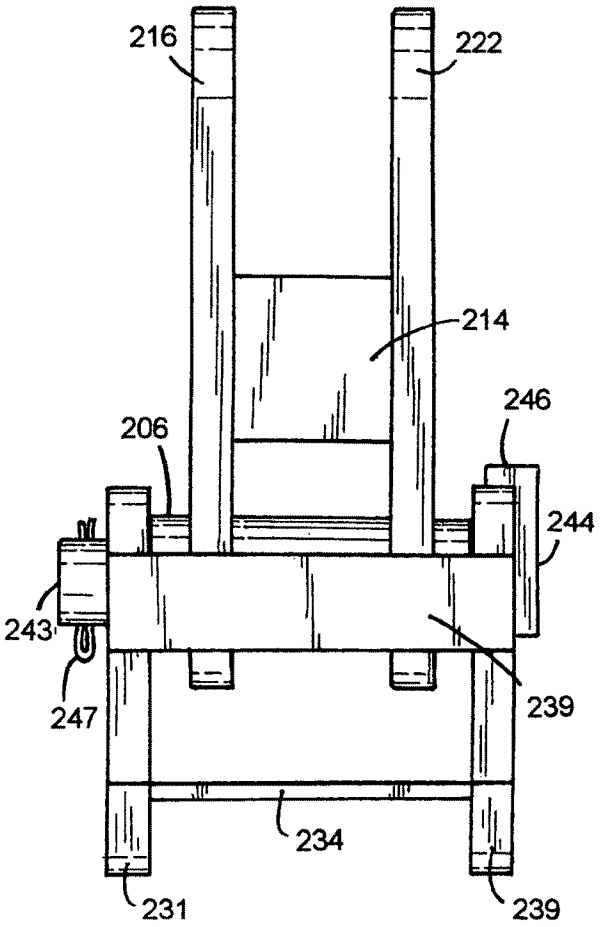
FIG. 33 is a rear elevational view of the hinge assembly of FIG. 27.
Figure 32:
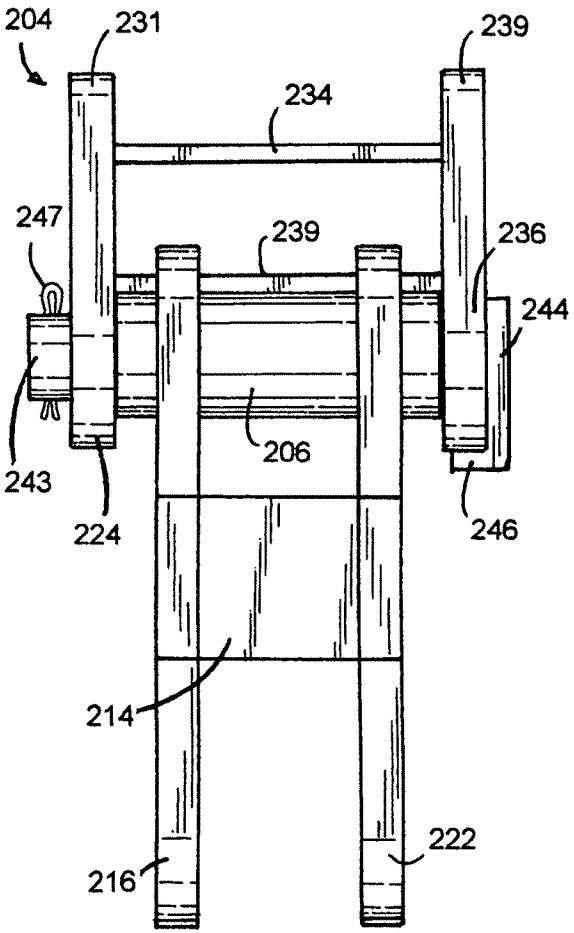
FIG. 32 is a front elevational view of the hinge assembly of FIG. 27.
Figure 34:
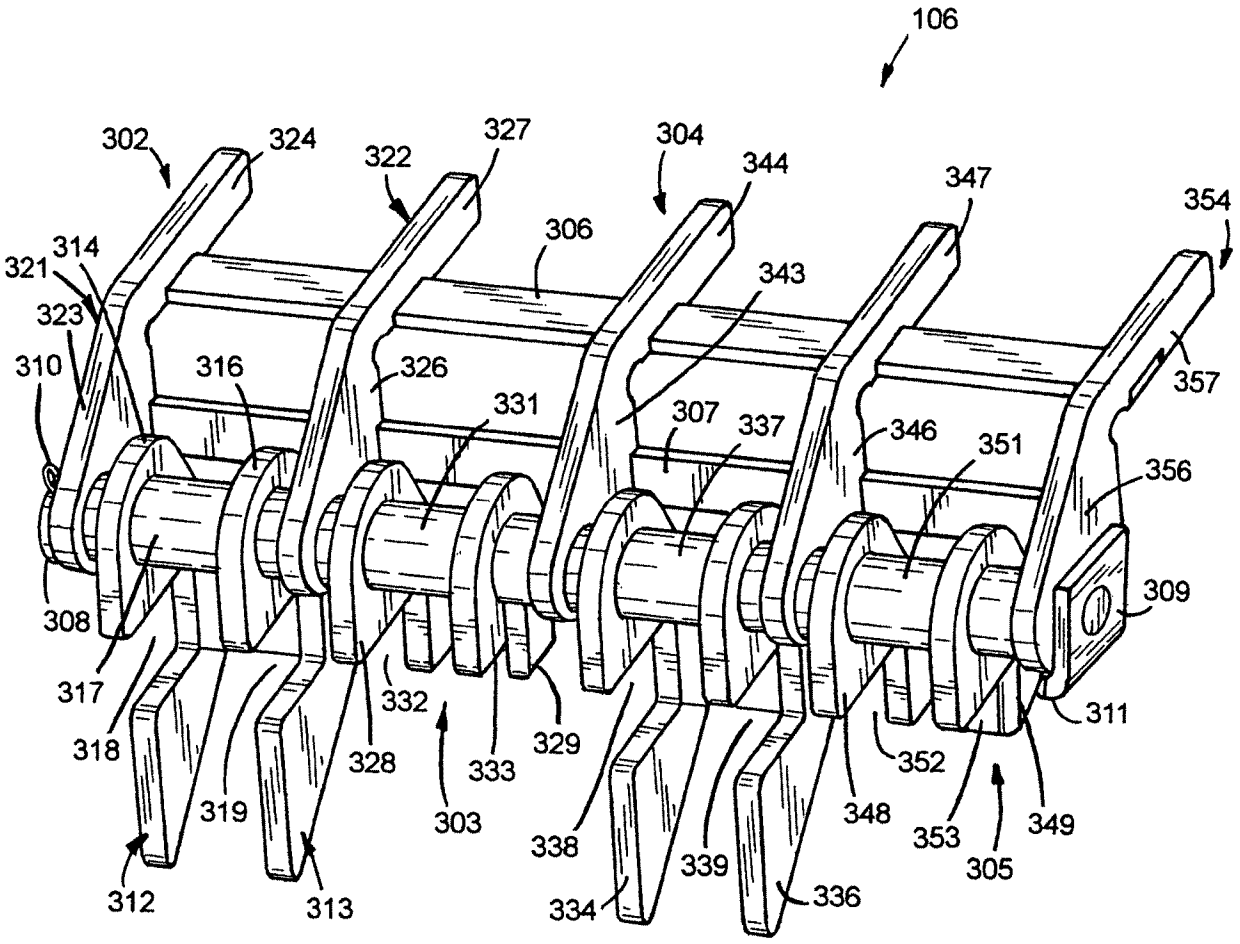
FIG. 34 is a perspective view of an end hinge assembly.
Figure 35:
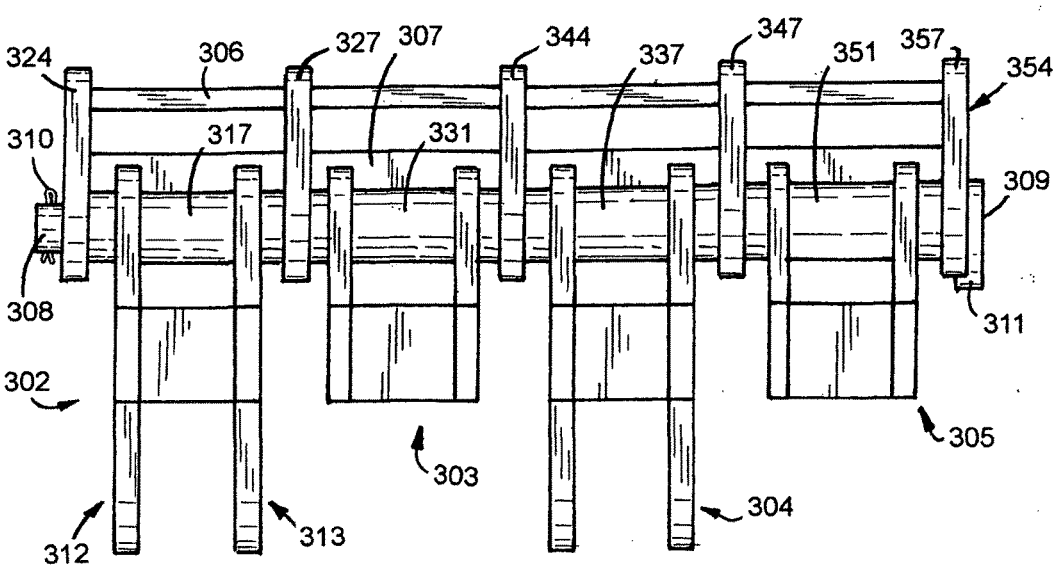
FIG. 35 is a front elevational view of the hinge assembly of FIG. 34.
Figure 36:
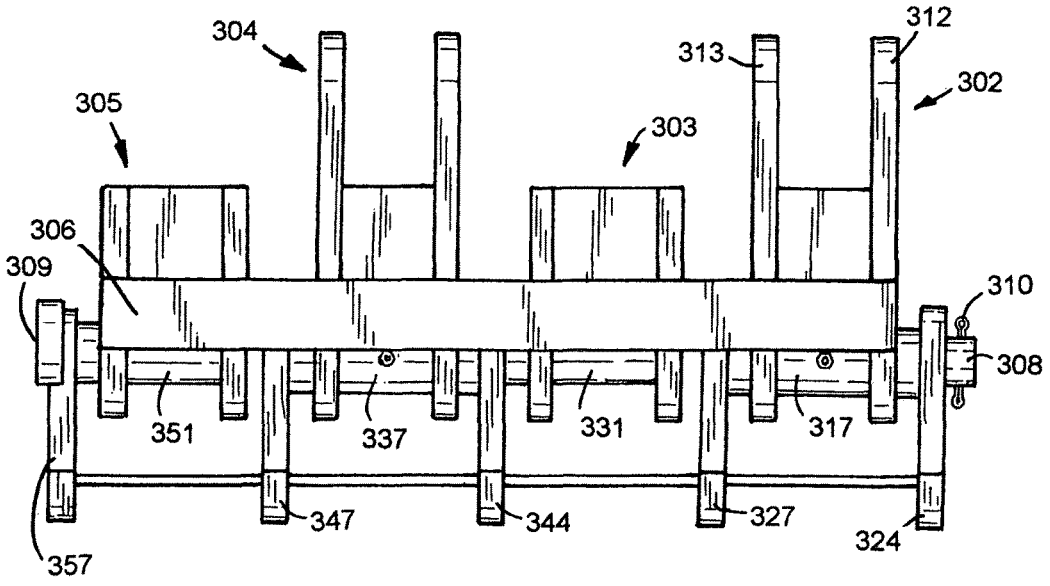
FIG. 36 is a rear elevational view of the hinge assembly of FIG. 34.
Figure 37:
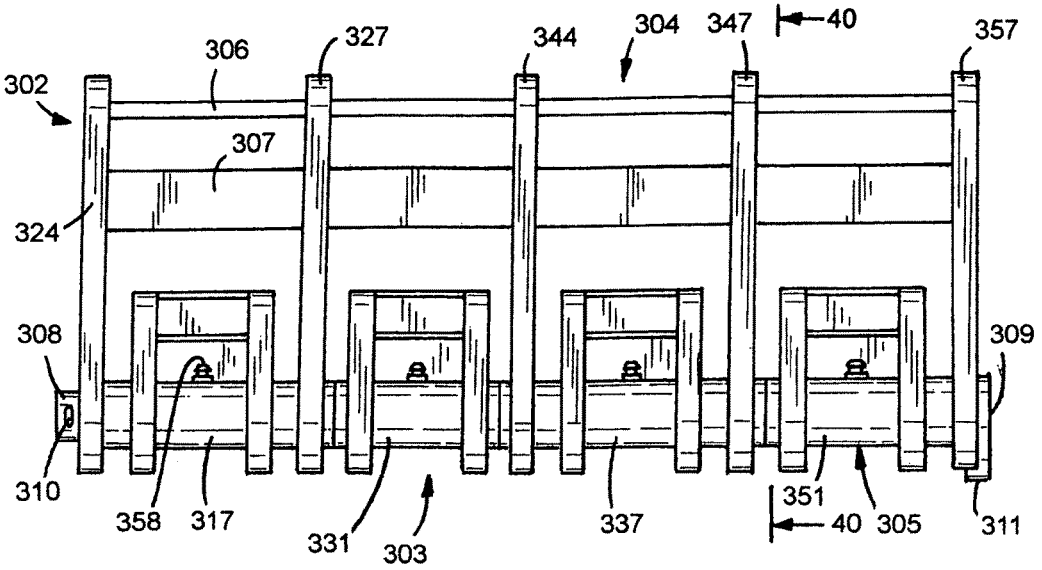
FIG. 37 is a top plan view of FIG. 34.
Figure 38:
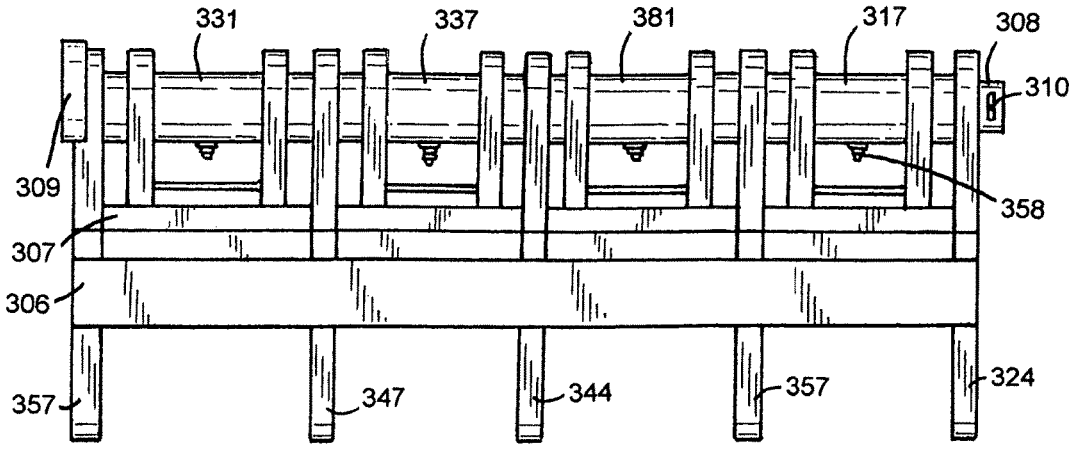
FIG. 38 is a bottom plan view of FIG. 34.
Figure 39:
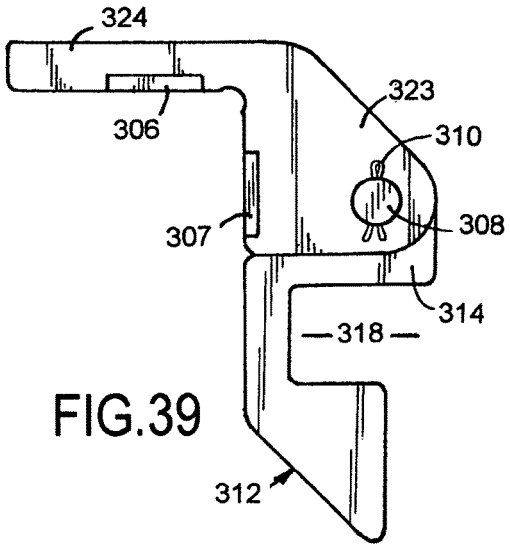
FIG. 39 is a side elevational view of the left side of the hinge assembly of FIG. 34.
Figure 40:
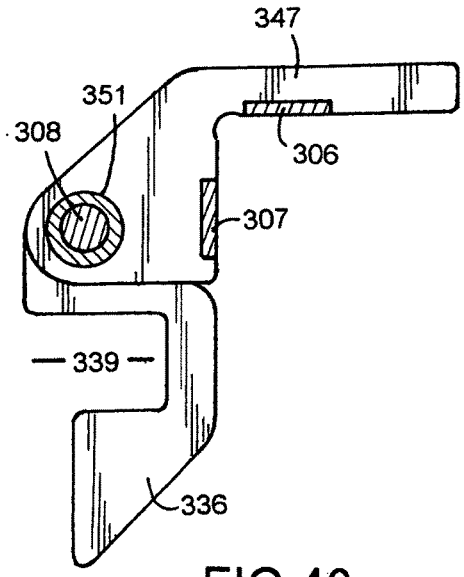
FIG. 40 is a sectional view taken along line 40-40 of FIG. 37.
Figure 41:
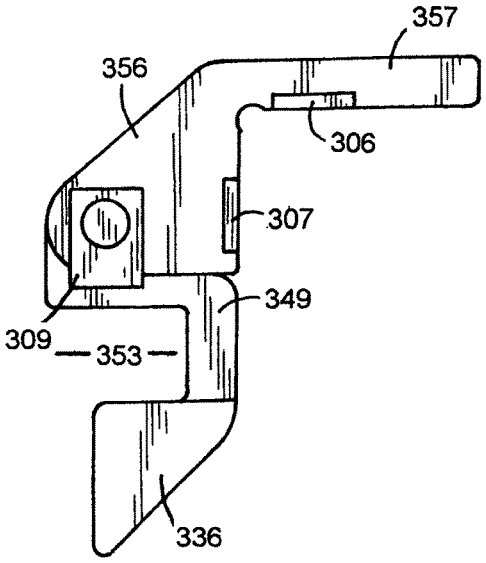
FIG. 41 is a side elevational view of the right side of FIG. 37.

An alternative embodiment of hinge assembly 202, shown in FIGS. 27 to 33, pivotally mounts door 100 on header 124 of frame assembly 101 for movement between the open and closed positions. Hinge assembly 202 has a cylindrical sleeve 206. A grease zerk 207 secured to a middle section of sleeve 206 is used to direct a lubricant, such as grease, to the inside cylindrical wall of sleeve 206. The lubricant facilitates rotation of sleeve 206 on a pin 243 extended through sleeve 206. A pair of laterally spaced first or door members 208 and 209 secured to sleeve 206 are attached to top member 109 of door frame 108 whereby sleeve 206 rotates on pin 243 when door 100 is moved between open and closed positions. Member 208 has a head 212 with an opening 213 accommodating sleeve 206. Head 212 is secured with a weld to sleeve 206. A neck 214 secures head 212 to a body 216 spaced from head 212 with a recess or pocket 217. As shown in FIG. 27, top member 109 of door frame 108 is located in pocket 217. A weld secures head 213, neck 214 and body 216 to top member 109 of door frame 108. Member 209 has a head 218 with an opening 219 accommodating sleeve 206. A weld secures head 218 to sleeve 206. A neck 221 secures head 218 to a body 222. A bar 211 extended between and secured to necks 214 and 221 maintains the lateral space between members 208 and 209 and reinforces members 208 and 209. Top member 109 of door frame 108 is located in a recess or pocket 223 between head 218 and body 222. A weld secures head 216, neck 221 and body 222 to top member 109 of door frame 108. Bodies 216 and 222 extend downward adjacent opposite sides of upright member 115 of door frame 108 and locate hinge assembly 202 in upright vertical alignment with member 115. Bodies 216 and 222 secured with welds to upright member 115 reinforce the attachment of upright member 115 to top member 109 and reinforce the attachment of hinge assembly 102 to door frame 108.

A pair of laterally spaced header members 224 and 236 support sleeve 206 and pin 243 in a horizontal position in front of header 124. Header member 224 has an opening 226 accommodating pin 243 adjacent an end of sleeve 206 and an upright wall 227 having a recess 228. A first cross bar 229 located in recess 228 is secured with a weld to member 224. The upper portion of member 224 has an arm 231 located in engagement with and secured to the top of header 124. Arm 231 has a bottom surface 232 with a recess 233. A second cross bar 234 located in recess 228 is secured with a weld to arm 231. Header member 236 has the same structure and function as header member 224. Member 236 has an upright wall 237 with a recess 238. Cross bar 229 located in recess 238 is welded to member 236. The upper portion of member 236 has an arm 239 with a bottom surface 241 having a recess 242. Second cross bar 234 located in recess 242 is secured with a weld to arm 239. Cross bars 229 and 234 maintain the lateral distance between and reinforce members 224 and 236. Members 224 and 236 and cross bars 229 and 234 secured with welds to header 124 support hinge assembly 202 on header 124.

Pin 243 is retained in a horizontal non-rotatable position with a tab 244 connected to an end of pin 243. Tab 244 has an ear 246, shown in FIGS. 27, 29, 32 and 33, located adjacent a portion of the bottom wall of member 236 for preventing turning of tab 224 and rotation of pin 243 relative to member 224 and 236. Sleeve 206 and door members 208 and 209 rotate on pin 243 during movement of door 100 between open and closed positions.

Hinge assemblies 103 and 104 have the same structures and functions as hinge assembly 102. Hinge assembly 202 can be used to replace hinge assemblies 103 and 104.

End hinge assembly 106, shown in FIGS. 35 to 41, has a series or number of hinge units 302, 303, 304 and 305 pivotally mounting an end of door frame 108 to header 124. Cross bars 306 and 307 join adjacent the hinge units, maintain the lateral spaces between the hinge units and reinforce the hinge units. Hinge unit 302 has a sleeve 317 rotatably mounted on a pin 308. Door members 312 and 313 have heads 314 and 316 secured to sleeve 317 and pockets 318 and 319 for accommodating top member 109 of door frame 108. Door members 312 and 313 have lower portions or bodies located adjacent opposite sides of upright member 112 of door frame 108. Welds secure door members 312 and 313 to upright member 112 thereby reinforcing door member 312 and 313 and the connection of upright member 112 to top member 109. Header members 321 and 322 mounted on pin 308 adjacent opposite ends of sleeve 317 are secured with welds to header 124.

Hinge unit 304 has the same structures and functions as hinge unit 302. Hinge unit 304 has a sleeve 337 rotatably mounted on pin 308. Door members 334 and 336 secured to sleeve 337 have recesses or pockets 338 and 339 for accommodating top member 109 of door frame 108.

A pair of header members 343 and 346 mounted on pin 308 adjacent opposite ends of sleeve 337 secured with welds to header 124 support hinge unit 304 on header 124. Header members 343 and 346 having arms 344 and 347 with recesses accommodating cross bars 306 and 307 are secured with welds to header 124. Hinge unit 303 located between hinge units 302 and 304 has a sleeve 331 rotatably mounted on pin 308. Door members 328 and 329 joined to sleeve 331 have recesses or pockets 332 and 333 for accommodating top member 109 of door frame 108. Door members 328 and 329 are secured with welds to top member 109 of door frame 108. Hinge unit 305 has the same structures and functions as hinge unit 303. Hinge unit 305 has a sleeve 351 rotatably mounted on pin 308. Door members 348 and 349 secured with welds to sleeve 351 have recesses or pockets 352 and 353 for accommodating top member 109 of door frame 108. Door members 348 and 349 are also secured with welds to top member 109 of door frame 108. An end member 354 has a body 356 mounted on pin 308 adjacent hinge unit 305 and an arm 357. Body 356 and arm 357, as shown in FIG. 18, are secured with welds to header 124. A tab 309 secured to an end of pin 308 has an ear 311 located below body 356. Ear 311 engages the bottom wall of body 356 to prevent turning of tab 309 and rotation of pin 308. The non-rotating pin 308 rotatably supports sleeves 317, 331, 337 and 351 for rotation about a generally horizontal axis. Tab 309 and fastener 310, shown as a cotter pin, retain pin 308 in assembled relation with sleeves 317, 331, 337 and 351 and header members 321, 322, 343, 346 and 354.

Hinge assembly 107 has the same structures and functions as hinge assembly 106. Hinge assemblies 106 and 107 support opposite ends of door 100 on header 124 of frame assembly 101.

The foregoing drawing and description of the frame assembly for an overhead door is one embodiment of the invention. Persons skilled in the art of overhead doors can make changes and modifications in structures and materials of the door, frame assembly and hinge assemblies without departing from the door, frame assembly and hinge assemblies defined in the claims.

The invention claimed is:

1. In combination:

a door, a frame assembly for supporting the door for movement between a door open position and a door closed position, said frame assembly including a generally horizontal header located in an upright plane, said header having opposite first and second ends, a first upright tubular column having a first upper tubular end, said first upper tubular end including a first wall and a second wall located perpendicular to the first wall, a second upright tubular column having a second upper tubular end, said second upper tubular end including a third wall and a fourth wall located perpendicular to the third wall, a first splice assembly permanently attached to the first end of the header, said first splice assembly being located in telescopic relationship with the first upper tubular end of the first upright tubular column, the first splice assembly including a first body having a first end surface and a second end surface opposite the first end surface and first and second ribs joined to the first body, the first and second ribs each having an outer edge engageable with the first wall of the first upright tubular column, first adjustable fasteners securing the first splice assembly to the first upper tubular end of the first upright tubular column and maintaining the first upright tubular column in the upright plane of the header, the first adjustable fasteners including at least one first fastener supported by the first upper tubular end of the first upright tubular column and operatively connected to the first body for holding the outer edge of each of the first and second ribs in engagement with the first wall of the first upright tubular column, and at least one second fastener mounted on the first upper tubular end of the first upright tubular column and engageable with the first end surface of the first body for holding the second end surface of the first body in engagement with the second wall of the first upright tubular column, a second splice assembly permanently attached to the second end of the header, said second splice assembly being located in telescopic relationship with the second upper tubular end of the second upright tubular column, the second splice assembly including a second body having a first end surface and a second end surface opposite the first end surface of the second body, and third and fourth ribs joined to the second body, each of the third and fourth ribs having an outer edge engageable with the third wall of the second upright tubular column, second adjustable fasteners securing the second splice assembly to the second upper tubular end of the second upright tubular column and maintaining the second upright tubular column in the upright plane of the header, the second adjustable fasteners including at least one third fastener supported by the second upper tubular end of the second upright tubular column and operatively connected to the second body for holding the outer edge of each of the third and fourth ribs in engagement with the third wall of the second upright tubular column, and at least one fourth fastener mounted on the second upper tubular end of the second upright tubular column and engageable with the first end surface of the second body for holding the second end surface of the second body in engagement with the fourth wall of the second upright tubular column, a plurality of hinge assemblies pivotally connecting the door to the header for pivotal movement of the door between the door open position and the door closed position, and linear actuators operatively connected to the first and second upright tubular columns and the door and operable to selectively move the door relative to the frame assembly to the door open position and the door closed position.

2. The combination of claim 1 wherein:

the first body includes a first side wall, the first and second ribs are secured to the first side wall of the first body, the first fastener including a first nut secured to the first body, and a threaded first bolt cooperating with the first nut to hold the first and second ribs in engagement with the first wall of the first upright tubular column, the second body including a second side wall, the third and fourth ribs are secured to the second side wall of the second body, and the third fastener including a second nut secured to the second body, and a threaded second bolt cooperating with the second nut to hold the third and fourth ribs in engagement with the third wall of the second upright tubular column.

3. The combination of claim 1 wherein:

the first body comprises a generally flat upright first body having an upright side wall, said first and second ribs being secured to the upright side wall of the flat upright first body, and the second body comprising a generally flat upright second body having an upright side wall, said third and fourth ribs being secured to the upright side wall of the flat upright second body.

4. The combination of claim 1 wherein:

each said hinge assembly comprises a tubular sleeve, at least one first member secured to the sleeve to connect the sleeve to the door, a pin extended through the tubular sleeve, at least one second member mounted on the pin, said at least one second member being connected to the header whereby the sleeve is retained on the pin during movement of the door between the door open and closed positions, and a third member secured to the pin, said third member being engageable with the second member to prevent rotation of the pin whereby the sleeve rotates on the pin during the movement of the door between door open and closed positions.

5. In combination:

a door for opening and closing an opening in a structure, a frame assembly for supporting the door for movement between door open and door closed positions relative to the opening in the structure, said frame assembly comprising a header located in an upright plane, said header having a first section and a second section opposite the first section, a first upright column having a first open upper end, a first wall and a second wall located perpendicular to the first wall, a second upright column having a second open upper end, a third wall and a fourth wall located perpendicular to the third wall, a first splice assembly permanently attached to the first section of the header, said first splice assembly having a first body engageable with the second wall and a plurality of first ribs joined to the first body, the first body and plurality of first ribs being located in the first open upper end of the first upright column, first adjustable fasteners securing the first body of the first splice assembly to the first upright column and maintaining the first upright column in the upright plane of the header, said first adjustable fasteners including at least one first fastener mounted on the first upright column and operatively connected to the first body to hold the plurality of first ribs in engagement with the first wall of the first upright column, a second splice assembly permanently attached to the second section of the header, said second splice assembly having a second body and a plurality of second ribs joined to the second body, the second body and plurality of second ribs being located in the second open upper end of the second upright column, second adjustable fasteners securing the second body of the second splice assembly to the second upright column and maintaining the second upright column in the upright plane of the header, said second adjustable fasteners including at least one second fastener mounted on the second upright column and operatively connected to the second body to hold the plurality of second ribs in engagement with the third wall of the second upright column, a plurality of assemblies connecting the door to the header for movement of the door between the door open position and the door closed position relative to the opening in the structure, and actuators operatively connected to the door and first and second columns to move the door relative to the frame assembly to open and close the opening in the structure.

6. The combination of claim 5 wherein:

the first body has a first body wall, said plurality of first ribs comprising a first pair of parallel spaced ribs secured to the first body wall and extended laterally away from the first body wall, first retainers secured to the first body between the first pair of parallel spaced ribs, said first adjustable fasteners being located between the first pair of parallel spaced ribs and engageable with the first column and the first retainers to connect the header to the first upright column, the second body having a second body wall, said plurality of second ribs comprising a second pair of parallel spaced ribs secured to the second body wall and extended away from the second body wall, second retainers secured to the second body between the second pair of parallel ribs, and said second adjustable fasteners being located between the second pair of parallel spaced ribs and engageable with the second column and the second retainers to connect the header to the second upright column.

7. The combination of claim 6 wherein:

the first retainers are nuts having threaded openings, and the first adjustable fasteners comprising bolts threaded into the threaded openings of the nuts thereby connecting the first upright column to the header.

8. In combination:

a door for opening and closing an opening in a structure, a frame assembly for supporting the door for movement between door open and door closed positions for opening and closing the opening in the structure, said frame assembly including a header, a column having a first wall, a second wall located perpendicular to the first wall, and an open end, a splice assembly permanently attached to the header, said splice assembly being located in the open end of the column, the splice assembly including a body having a first end and a second end opposite the first end and first and second ribs joined to the body, the first and second ribs each having an outer edge engageble with the first wall of the column, adjustable fasteners securing the splice assembly to the column, the adjustable fasteners including at least one first fastener supported by the column and operatively connected to the body for holding the outer edge of each of the first and second ribs in engagement with the first wall of the column and at least one second fastener mounted on the column and engageable with the first end of the body for holding the second end of the body in engagement with the second wall of the column, a plurality of hinge assemblies connecting the door to the header for movement of the door between the door open position and the door closed position and at least one actuator operatively connected to the column and the door and being operable to selectively move the door relative to the frame assembly to the door open position and the door closed position.

9. The combination of claim 8 wherein:

the first fastener comprises at least one nut secured to the body, and the first fastener comprises a threaded bolt cooperating with the one nut to hold the first and second ribs in engagement with the first wall of the column.

10. The combination of claim 8 wherein:

each said hinge assembly comprises a tubular sleeve, at least one first member secured to the sleeve to connect the sleeve to the door, a pin extended through the tubular sleeve, at least one second member mounted on the pin, said at least one second member being connected to the header whereby the sleeve is retained on the pin during movement of the door between the door open position and the door closed position, and a third member secured to the pin, said third member being engageable with the second member to prevent rotation of the pin whereby the sleeve rotates on the pin during the movement of the door between the door open position and the door closed position.

11. The combination of claim 8 wherein:

the first fastener includes a first bolt and a first retainer, said first retainer being attached to the body adjacent the first and second ribs, and said first bolt being engageable with the column and cooperating with the first retainer to hold the first and second ribs in engagement with the first wall of the column thereby connecting the header to the column, the second fastener includes a second bolt and a second retainer, said second retainer being secured to the column, and said second bolt having an end engageable with the first end of the body and cooperating with the second retainer to hold the second end of the body in engagement with the second wall of the column concurrently with the engagement of the first and second ribs with the first wall of the column.

12. The combination of claim 11 wherein:

the first retainer is a first nut having a threaded opening, the first nut being secured to said body adjacent to the first and second ribs, and the first bolt being extended through a hole in the column and threaded into the threaded opening of the first nut whereby the first bolt cooperates with the first nut to hold the first and second ribs in engagement with the first wall of the column and connect the header to the column.

13. The combination of claim 12 wherein:

the second retainer is a second nut having a threaded opening.

* * * * *